US007142801B2

(12) United States Patent
Kitani et al.

(10) Patent No.: US 7,142,801 B2
(45) Date of Patent: Nov. 28, 2006

(54) IMAGE FORMING APPARATUS AND IMAGE FORMING METHOD

(75) Inventors: Tomoe Kitani, Hino (JP); Masao Asano, Tokyo (JP)

(73) Assignee: Konica Minolta Holdings, Inc., Tokyo (JP)

( * ) Notice: Subject to any disclaimer, the term of this patent is extended or adjusted under 35 U.S.C. 154(b) by 0 days.

(21) Appl. No.: 11/220,041

(22) Filed: Sep. 6, 2005

(65) Prior Publication Data

US 2006/0029439 A1 Feb. 9, 2006

Related U.S. Application Data

(63) Continuation-in-part of application No. 10/802,146, filed on Mar. 16, 2004, now abandoned.

(51) Int. Cl.
*G03G 15/01* (2006.01)

(52) U.S. Cl. ..... 399/302; 399/298; 430/107.1

(58) Field of Classification Search ..... 399/298–299, 399/302, 306; 430/45, 107.1, 111.4
See application file for complete search history.

(56) References Cited

U.S. PATENT DOCUMENTS 5,837,414 A * 11/1998 Kitani et al. ..... 430/108.1
6,641,965 B1 * 11/2003 Nakamura et al. ..... 430/107.1
7,016,634 B1 * 3/2006 Kitani et al. ..... 399/298
2004/0190951 A1 * 9/2004 Kitani et al. ..... 399/299
2004/0248023 A1 * 12/2004 Asano et al. ..... 430/45

* cited by examiner

*Primary Examiner*—Yaritza Guadalupe-McCall
(74) *Attorney, Agent, or Firm*—Lucas & Mercanti, LLP

(57) ABSTRACT

An image forming apparatus including: a plurality of image forming units each having at least an electrophotographic photoreceptor, a latent image forming device to form an electrostatic latent image on the electrophotographic photoreceptor, a developing device to develop the electrostatic latent image with toner to form visible toner image on the electrophotographic photoreceptor, a transferring device to transfer the visible toner image onto a toner image receiving member and a cleaning device to remove the toner remaining on the electrophotographic photoreceptor after transferring the visible toner image by the transferring device, wherein the plurality of image forming units are arranged so as to transfer and pile up the visible toner images successively onto said other material to form a toner image, and wherein the toners used in each of the image forming units have different colors and the turbidity of less than 60, and the difference of the turbidity of the toner having the highest turbidity and that of the toner having the lowest turbidity among the toners is 5 to 45.

20 Claims, 4 Drawing Sheets

IMAGE FORMING APPARATUS AND IMAGE FORMING METHOD

This application is a continuation-in-part application of U.S. patent application Ser. No. 10/802,146, filed on Mar. 16, 2004 now abandoned.

TECHNICAL FIELD

The present invention relates to an image forming apparatus and an image forming method using the image forming apparatus.

BACKGROUND

It is recent tendency that color images are required even in the field of copying machine or printer. Color image forming methods with high practical value can be roughly classified according to usual called name into a transfer drum method, an intermediate transfer method, a KNC method in which several colored images are piled on a photoreceptor and transferred collectively, and a tandem method.

Of course such the names are each given from different viewpoint, accordingly, for example, a method composed of the intermediate transfer method and the tandem method can be naturally used. The color image forming apparatus by the tandem method is known as an apparatus giving a high quality full color image. In the tandem method, toner images are separately formed on photoreceptors each corresponding to color of yellow, magenta, cyan, or magenta, and the color images are piled on an intermediate transfer member and the piled image is collectively transferred onto an image recording material.

In the tandem image forming method, an image defect caused by imperfect transfer of the toner image tends to occur since the method includes two transfer steps, the first transfer step for transferring the toner image from each of the photoreceptors to the intermediate transfer member and the second step for transferring the image from the intermediate transfer member to the recording paper.

For example, the imperfection of the transfer of the toner from the photoreceptor to the intermediate transfer member tends to cause image defects such as reducing of image density and lacking of transferred image. Besides, it has been reported that the imperfection of the toner transfer from the intermediate transfer member to the image recording paper causes scattering of character image and lowering of sharpness caused by rebound of the toner in the transfer process and periodical defects caused by toner filming on the photoreceptor.

On the other hand, technique for raising the color image quality is developed, by which a fine latent image is formed on the photoreceptor by using a light source with a small spot diameter to form a fine dot image. For example, a method is known in which a fine latent image is formed on an organic photoreceptor using a light beam having a spot diameter of not more than 4,000 $\mu m^2$ such as that disclosed in Japanese Patent Publication Open to Public Inspection, hereinafter referred to as JP O.P.I. Publication, No. 8-272197.

It is necessary for exactly reproducing such the fine dot image as a toner image to prevent the lowering of the sharpness caused by lacking of toner transfer or scattering of character image caused by imperfect transfer and the periodical image defects caused by toner filming on the intermediate member.

For improving the charging property, developing ability and transferring ability, which are cause of the toner transfer lacking and the character image scattering, and for preventing toner filming or improving the imperfection of cleaning, techniques have been investigated by which fine particles are added into the photoreceptor layer to give irregularity to the surface thereof so that the toner adhesive force of the photoreceptor surface is reduced for improving the transfer ability and for reducing the frictional force of the surface to a blade. For example, JP O.P.I. Publication No. 5-181291 discloses that fine particles of alkylsilsesquioxane resin are added in the photosensitive layer. A problem rises, however, that the transfer ability tends to be lowered under a high humidity condition since the fine particles of alkylsilsesquioxane resin has hygroscopicity and the wettability of the photoreceptor surface or the surface energy of the surface is raised under such the condition. On the other hand, an electrophotographic photoreceptor containing particles of fluororesin for reducing the surface energy has been disclosed. However, sufficient surface strength cannot be obtained by the fluororesin particles and line-shaped defects caused by damage of the photoreceptor surface and image scattering tend to occur, cf. JP O.P.I. Publication No. 63-56658.

Besides, a technique for improving the transferring ability of the intermediate transfer member by supplying a solid lubricant to the intermediate transfer member to lower the surface energy is disclosed in, for example, JP O.P.I. Publication Nos. 6-337598, 6-332324 and 7-271142. It is found, however, that the solely controlling of the surface property of the intermediate transfer member is insufficient for improving the total transferring ability in the image forming method having the twice transfer processes using the intermediate transfer member, and further improvement is necessary regarding the copy image formation for a long period or under a high temperature and humidity condition.

From the viewpoint of the electrophotographic process, the image formation process is roughly classified into an analogical image formation using a halogen lamp as the light source and a digital image formation using a LED or laser as the light source. Recently, the main stream of the technology is rapidly changed, in the field of not only the printer for personal computer but the ordinary copy machine, to digital image forming method since the processing of image and the expansion to a complex image forming machine are easy realized.

Higher quality of the image tends to be required to the digital image forming method since such the method is applied for not only copying but formation of an original image.

Corresponding to such the requirement of the high quality image, it has been investigated that the latent image is conscientiously developed the latent image formed on the electrophotographic photoreceptor by using a small diameter toner controlled in the shape factor and the particle distribution. However, the transferring ability and the cleaning ability cannot be improved as expected and the lacking of toner transfer and the character image scattering tend to occur in the forgoing image forming method using the intermediate transfer member even when such the toner is used.

It is found that it is necessary to improve the toner transferring ability of both of the primary transfer and the secondary transfer in total by controlling the balance between the surface energy of the electrophotographic photoreceptor and that of the intermediate transferring member and improving the properties of the toner to suit to the intermediate transfer method.

Besides, an image forming apparatus is known as an embodiment of tandem method image forming apparatus for forming a color image, in which toner images are formed by each of electrophotographic photoreceptors each corresponding to color of yellow, magenta, cyan, and black, respectively, and the toner images are piled up on the recording medium to form a color image, cf. JP O.P.I. Publication No. 2001-222129.

In such the color image formation by the tandem method, image defects caused by imperfection of the toner transfer frequently occur since the toner images are piled up by directly transfer from the electrophotographic photoreceptor of each of the image forming units to the recording material or recording paper.

For example, the imperfection of the transfer tends to occur according to the kind of the recording paper, and the image defects such as the lowering of the image density, the lacking of toner transfer, and the scattering of character image caused by rebounding of the toner transfer occur, as a result of that the color image with lowered sharpness tends to be obtained. Particularly, the image quality is considerably degraded when a black image exists in the color image and the character image scattering caused by the rebounding in the course of transfer occurs in the blacken image.

In the color image forming apparatus, the ratio of formation of character images is larger than that of color images and the wearing of the photoreceptor and the degradation of the developer is easily progressed in the black image forming system. Therefore, it is important for the color image formation to maintain the charging ability, the developing ability and the transfer ability of the black image at a high level. Accordingly, it is necessary for leveling up the quality of the color image to mainly prevent the lowering of the sharpness and degradation of the color reproducibility caused by the toner transfer lacking and the character scattering accompanied with the degradation of the charging ability, the developing ability, and the transferring ability in the black image forming system.

As above-mentioned, in the color image forming system by the tandem method in which the toner image is directly transferred from the electrophotographic photoreceptor to the recording material, the foregoing improvement of the photoreceptor is insufficent to prevent the lowering of the image density and the image defects such as the lacking of toner transfer and the scattering of character image, and improvements of the developing ability and the transferring ability of each color toners, particularly those of the black toner, are necessary for improving the development of the electrostatic latent image on the photoreceptor and the transfer of the toner image from the photoreceptor to the recording material so that the toner image is sufficiently transferred to the recording material.

The invention is attained to solve the foregoing problems. The object of the invention is to provide a good electrophotographic color image by the image forming apparatus using the intermediate transfer member, particularly to provide an electrophotographic image forming apparatus and an image forming method by which the lacking of toner transfer the scattering of character image and the degradation of sharpness are improved, which are easy to occur in the color image formed by the apparatus using the intermediate transferring member, so as to form a color image with high sharpness and clear hue when the fine dot image or a lot of the images are formed.

The invention has been attained based on the detailed investigation on the primary transferring ability of the toner image from the photoreceptor to the intermediate transferring member and the secondary transferring ability of the toner image from the intermediate transferring member to the recording material in the image forming apparatus for forming a color image using the intermediate transferring member. As a result of the investigation, it has been found that the amount of the free external additive in each of the color toners largely participates with the primary and secondary transferring ability, particularly with the secondary transferring ability from the intermediate transferring member to the recording material. The transferring ability of the toner from the intermediate transferring member to the recording material is considerably improved by the use of a toner having a large amount of free external additive or high turbidity so that an electrophotographic color image having few image defects such as the transfer lacking and the character scattering and the high sharpness can be obtained.

The further object of the invention is to provide an image forming apparatus having plural image forming units and an image forming method by which the toner images each formed on the image forming units are directly transferred and piled up onto the recording material to form an electrophotographic image with good color, particularly, to provide the image forming apparatus and the image forming method by which the reproducibility degradation of the black image in a color image including a character image and the image defects such as the character image scattering and the toner transfer lacking are prevented so that a color image having high sharpness and color reproducibility is formed.

The invention is attained by the found that in an image forming apparatus in which toner images having different color from each other are formed by the use of color toners each charged in each of plural image forming units, and the toner images are successively transferred and piled up onto the recording material from the electrophotographic photoreceptor and fixed to form a color image, the amounts and their balance of the free external additive in the each of toner images formed by each color of the toners on the photoreceptor are largely participates with the developing ability and the transferring ability, particularly on the occasion of the each color toner images are transferred onto the recording material for piling up the toners on the recording material. Namely, the reproducibility of the black toner image can be held and the transfer ability of the toner images of each colors is considerably improved by the use of the toners in which the amount of the free external additive is reduced in the black toner compared with the other color toners and the amount of that is increased in at least one of the toners other than the black toner. Thus the electrophotographic image can be formed which has good color and high sharpness and few image defects such as toner transfer lacking and the character image scattering tending to occur in the color image.

SUMMARY

It is therefore an object of the present invention to provide an image forming apparatus including: a plurality of image forming units each having at least an electrophotographic photoreceptor, a latent image forming device to form an electrostatic latent image on the electrophotographic photoreceptor, a developing device to develop the electrostatic latent image with toner to form visible toner image on the electrophotographic photoreceptor, a transferring device to transfer the visible toner image onto a toner image receiving member and a cleaning device to remove the toner remaining on the electrophotographic photoreceptor after transferring the visible toner image by the transferring device, wherein the plurality of image forming units are arranged so as to transfer and pile up the visible toner images successively onto said other material to form a toner image, and wherein the toners used in each of the image forming units have different colors and the turbidity of less than 60, and the difference of the turbidity of the toner having the highest turbidity and that of the toner having the lowest turbidity among the toners is 5 to 45.

DETAILED DESCRIPTION OF PREFERRED EMBODIMENT

Figure 1:
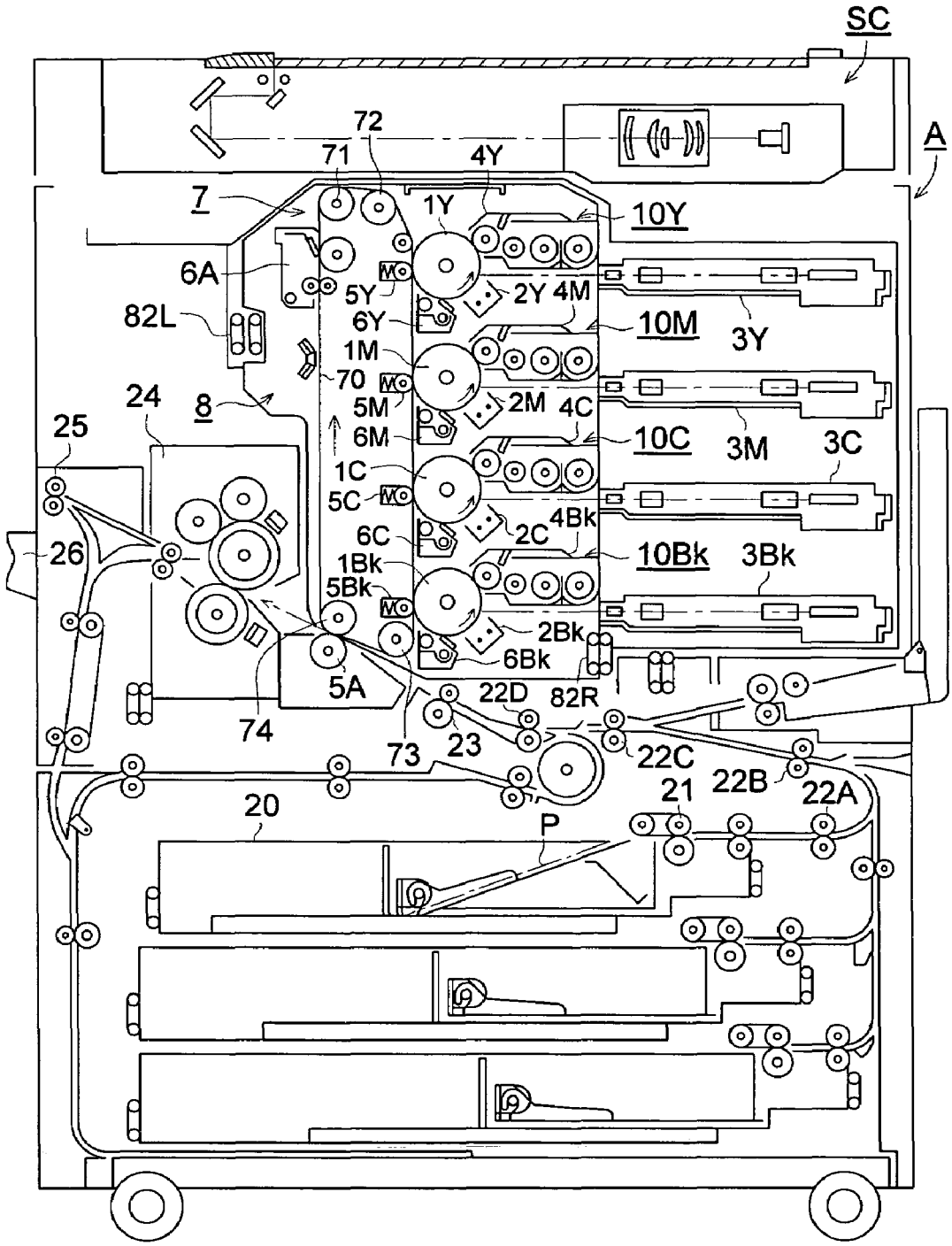
FIG. 1 shows a cross section of the constitution of a color image forming apparatus as an embodiment of the invention.

The invention is described in detail below.

An objects of the invention can be attained by any one of the following constitution.

1.1. An image forming apparatus having arranged plural image forming units each comprising at least an electrophotographic photoreceptor, a charging means, an exposing means (a latent image forming device), a developing means (a developing device) and a cleaning means (cleaning device), in which color toner images each formed by toners each having different colors and respectively used in each of the image forming units are successively transferred and piled up onto an intermediate transferring member (an intermediate transferring device) to form a toner image, and the toner image is collectively retransferred onto a recording material and the retransferred image is fixed to form a color image, wherein the turbidity of each of the color toners to be used in the plural image forming units is less than 60 and the largest difference of the turbidity among the color toners (the difference of the turbidity of the toner having the highest turbidity and that of the toner having the lowest turbidity among the plural toners to be used as a group) is 5 to 45.

1.2. An image forming apparatus having arranged plural image forming units each comprising at least an electrophotographic photoreceptor, a charging means, an exposing means, a developing means and a cleaning means, in which color toner images each formed by toners each having different colors and respectively used in each of the image forming units are successively transferred and piled up onto an intermediate transferring member to form a toner image, and the toner image is collectively retransferred onto a recording material and the retransferred image is fixed to form a color image, wherein the surface layer the electrophotographic photoreceptor of at least one of the plural image forming units contains a fluororesin particle and the turbidity of each of the color toners to be used in the plural image forming units is less than 60 and the largest difference of the turbidity among the color toners is from 5 to 45.

1.3. An image forming apparatus having arranged plural image forming units each comprising at least an electrophotographic photoreceptor, a charging means, an exposing means, a developing means and a cleaning means, in which color toner images each formed by toners each having different colors and respectively used in each of the image forming units are successively transferred and piled up onto an intermediate transferring member to form a toner image, and the toner image is collectively retransferred onto a recording material and the retransferred image is fixed to form a color image, wherein at least one of the plural image forming units has an agent supplying means for supplying a surface energy reducing agent to the electrophotographic photoreceptor and the turbidity of each of the color toners to be used in the plural image forming units is less than 60 and the largest difference of the turbidity among the color toners is from 5 to 45.

1.4. An image forming apparatus having arranged plural image forming units each comprising at least an electrophotographic photoreceptor, a charging means, an exposing means, a developing means and a cleaning means, in which color toner images each formed by toners each having different colors and respectively used in each of the image forming units are successively transferred and piled up onto an intermediate transferring member to form a toner image, and the toner image is collectively retransferred onto a recording material and the retransferred image is fixed to form a color image, wherein the turbidity of each of the color toners to be used in the plural image forming units is less than 60 and the largest difference of the turbidity among the color toners is from 5 to 45, and the sum M of the relative frequency $m_1$ of toner particles included in the highest frequent class and the relative frequency of the toner particles $m_2$ included in the next frequent class is not less than 70% in a histogram showing the distribution of number based particle diameter classified in to plural classes at intervals of 0.23 on the horizontal axis of natural logarithm ln D, D is the diameter of the toner particle in μm.

1.5. The image forming apparatus described in any one of 1.1 through 1.4 wherein the largest difference of the turbidity among the color toners is from 10 to 35.

1.6. The image forming apparatus described in any one of 1.1 through 1.4, wherein the plural image forming units are four image forming units composed of an image forming unit having a black toner, an image forming unit having a yellow toner, an image forming unit having a magenta toner and an image forming unit having a cyan toner.

1.7. The image forming apparatus described in any one of 1.1 through 1.6, wherein the turbidity of the black toner is less than 20.

1.8. An image forming method wherein an electrophotographic image is formed by the use of the image forming apparatus described in any one of 1.1 through 1.7.

2.1. An image forming apparatus having arranged plural image forming units each comprising at least an electrophotographic photoreceptor, a charging means, an exposing means, a developing means and a cleaning means, in which color toner images each formed by toners each having different colors and respectively used in each of the image forming units are successively transferred and piled up onto an intermediate transferring member to form a toner image, and the toner image is collectively retransferred onto a recording material and the retransferred image is fixed to form a color image, wherein the spot area of the exposure light beam to be used as the exposing means of each of the plural image forming units is not more than 2,000 $\mu m^2$ and the largest different of the turbidity among the color toners is from 5 to 45.

2.2. An image forming apparatus having arranged plural image forming units each comprising at least an electrophotographic photoreceptor, a charging means, an exposing means, a developing means and a cleaning means, in which color toner images each formed by toners each having different colors and respectively used in each of the image forming units are successively transferred and piled up onto an intermediate transferring member to form a toner image, and the toner image is collectively retransferred onto a recording material and the retransferred image is fixed to form a color image, wherein the spot area of the exposure light beam to be used as the exposing means of each of the plural image forming units is not more than 2,000 $\mu m^2$ and the largest different of the turbidity among the color toners is from 5 to 45.

2.3. An image forming apparatus having arranged plural image forming units each comprising at least an electrophotographic photoreceptor, a charging means, an exposing means, a developing means and a cleaning means, in which color toner images each formed by toners each having different colors and respectively used in each of the image forming units are successively transferred and piled up onto an intermediate transferring member to form a toner image, and the toner image is collectively retransferred onto a recording material and the retransferred image is fixed to form a color image, wherein at least one of the plural image forming units has an agent supplying means for supplying a surface energy reducing agent to the electrophotographic photoreceptor, the spot area of the exposure light beam to be used as the exposing means of each of the plural image forming units is not more than 2,000 $\mu m^2$, the turbidity of each of the color toners to be used in the plural image forming units is less than 60, and the largest different of the turbidity among the color toners is from 5 to 45.

2.4. An image forming apparatus having arranged plural image forming units each comprising at least an electrophotographic photoreceptor, a charging means, an exposing means, a developing means and a cleaning means, in which color toner images each formed by toners each having different colors and respectively used in each of the image forming units are successively transferred and piled up onto an intermediate transferring member to form a toner image, and the toner image is collectively retransferred onto a recording material and the retransferred image is fixed to form a color image, wherein the spot area of the exposure light beam to be used as the exposing means of each of the plural image forming units is not more than 2,000 $\mu m^2$, the turbidity of each of the color toners to be used in the plural image forming units is less than 60, the largest different of the turbidity among the color toners is from 5 to 45, and the sum M of the relative frequency $m_1$ of toner particles included in the highest frequent class and the relative frequency of the toner particles $m_2$ included in the next frequent class is not less than 70% in a histogram showing the distribution of number based particle diameter classified in to plural classes at intervals of 0.23 on the horizontal axis of natural logarithm ln D, D is the diameter of the toner particle in $\mu m$.

2.5. The image forming apparatus described in any one of 2.1 through 2.4 wherein the largest difference of the turbidity among the color toners is from 10 to 35.

2.6. The image forming apparatus described in any one of 2.1 through 2.5, wherein the plural image forming units are four image forming units composed of an image forming unit having a black toner, an image forming unit having a yellow toner, an image forming unit having a magenta toner and an image forming unit having a cyan toner.

2.7. The image forming apparatus described in any one of 2.1 through 2.6, wherein the turbidity of the black toner is less than 20.

2.8. An image forming method, wherein an electrophotographic image is formed by the use of the image forming apparatus described in any one of 2.1 through 2.7.

3.1. An image forming apparatus having arranged plural image forming units each comprising at least an electrophotographic photoreceptor, a charging means, an exposing means, a developing means and a cleaning means, in which color toner images each formed by toners each having different colors and respectively used in each of the image forming units are successively transferred and piled up onto a recording material to form a color toner image and the color toner image is fixed to form a color image, wherein the turbidity of each of the color toners to be used in the plural image forming units is less than 60, the largest difference of the turbidity among the toners is from 5 to 45, and one of the developing means has a black toner having a turbidity of less than 25.

3.2. An image forming apparatus having arranged plural image forming units each comprising at least an electrophotographic photoreceptor, a charging means, an exposing means, a developing means and a cleaning means, in which color toner images each formed by toners each having different colors and respectively used in each of the image forming units are successively transferred and piled up onto a recording material to form a color toner image and the color toner image is fixed to form a color image, wherein the surface layer of at least one of the electrophotographic photoreceptor of the plural image forming units contain a fluororesin particle, the turbidity of each of the color toners to be used in the plural image forming units is less than 60, the largest difference of the turbidity among the toners is from 5 to 45, and one of the developing means has a black toner having a turbidity of less than 25.

3.3. An image forming apparatus having arranged plural image forming units each comprising at least an electrophotographic photoreceptor, a charging means, an exposing means, a developing means and a cleaning means, in which color toner images each formed by toners each having different colors and respectively used in each of the image forming units are successively transferred and piled up onto a recording material to form a color toner image and the color toner image is fixed to form a color image, wherein at least one of the plural image forming units has an agent supplying means for supplying a surface energy reducing agent to the surface of the electrophotographic photoreceptor, the turbidity of each of the color toners to be used in the plural image forming units is less than 60, the largest difference of the turbidity among the toners is from 5 to 45, and one of the developing means has a black toner having a turbidity of less than 25.

3.4. An image forming apparatus having arranged plural image forming units each comprising at least an electrophotographic photoreceptor, a charging means, an exposing means, a developing means and a cleaning means, in which color toner images each formed by toners each having different colors and respectively used in each of the image forming units are successively transferred and piled up onto a recording material to form a color toner image and the color toner image is fixed to form a color image, wherein the turbidity of each of the color toners is less than 60, the largest difference of the turbidity among the toners is from 5 to 45, and the sum M of the relative frequency $m_1$ of toner particles included in the highest frequent class and the relative frequency of the toner particles $m_2$ included in the next frequent class is not less than 70% in a histogram showing the distribution of number based particle diameter classified in to plural classes at intervals of 0.23 on the horizontal axis of natural logarithm ln D, D is the diameter of the toner particle in μm.

3.5. The image forming apparatus described in any one of 3.1 through 3.4 wherein the largest difference of the turbidity among the color toners is from 10 to 35.

3.6. The image forming apparatus described in any one of 3.1 through 3.5, wherein the plural image forming units are four image forming units composed of an image forming unit having a black toner, an image forming unit having a yellow toner, an image forming unit having a magenta toner and an image forming unit having a cyan toner.

3.7. The image forming apparatus described in any one of 3.1 through 3.6, wherein the turbidity of the black toner is less than 20.

3.8. An image forming method, wherein an electrophotographic image is formed by the use of the image forming apparatus described in any one of 3.1 through 3.7.

In the invention, the turbidity of the toner can be defined and measured as follows.

A ratio of a diffused component to a totally transmitted component for an incident light is calculated, and a HAZE value thus obtained is caused to represent a turbidity.

The turbidity is defined to be as follows.

HAZE value=(Diffused component/Totally transmitted component)×100

Measuring Method of Toner Turbidity;

<Preparation of Dispersions>

Toner weighing 5 g and 50 ml of 0.7% aqueous dodecylbenzenesulfonic acid sodium salt solution are put in a beaker having a capacity of 100 ml, and they are stirred by a magnetic stirrer to be diffused. stirrer used; Model MS500D made by Yamato Scientific Co., Ltd.

Stirring conditions: 300 r.p.m., 5 minutes

<Centrifugal Separation>

An aqueous solution in which toner is diffused is subjected to centrifugal separation on a centrifugal separator, under the conditions of 292G and 10 minutes.

Centrifugal separator used: Model H-900, made by Kokusan Co., Ltd.

Rotor: PC-400 (Radius 18.1 cm)

Revolutions per minute: 1200 r.p.m. (292 G)

Time: 10 minutes

After the centrifugal separation, 40 ml of supernatant liquid is taken out. In this case, the supernatant liquid is taken out carefully by using a pipette so that sedimental toner may not be taken out. Additionally, the supernatant liquid is carefully taken out within 10 minutes after the centrifugal separation.

<Measurement of HAZE Value)

A HAZE value of the supernatant liquid is measured by using a Haze Measuring Equipment employing an integrating sphere.

Haze Measuring Equipment: Model COH-300A, made by Nippon Denshoku Industries Co., Ltd.)

Cell used: 10 mm A lager turbidity value of the toner means a larger amount of the free fine particle ingredient such as the external additive.

In the invention, the transferring ability of the color toner images piled up onto the intermediate transferring member is considerably improved and the image defects such as the lacking of toner transfer, scattering of character image, and the cyclical image defect caused by toner filming on the intermediate transferring member are also considerably improved, and a color image having high sharpness and clear hue can be formed by the use of a group of toners each having a turbidity of less than 60 and the largest difference among the toners is from 5 to 45.

When the turbidity of the toner exceeds 60, the free ingredient is scattered on the photoreceptor and the intermediate transferring member and the character scattering and the lowering of sharpness tend to occur. Furthermore, much free ingredient is adhered onto the photoreceptor surface so that the image defects such as a black spot (strawberry like-shaped spot image) tends to occur. When the largest difference of the turbidity among the toners is less than 5, the transferring ability of the toner from the photoreceptor to the recording material or the intermediate transferring member and that of the toner from the intermediate transferring member to the recording material are tend to be lowered and the lacking of transfer, lowering of image density of the color image and lowering of the sharpness tend to occur even when the turbidity of each of the color toners is less than 60. On the other hand, when the largest difference of the turbidity among the toners is more than 45, the balance of the charging amount among the toners is difficultly controlled, and the scattering of the character and lowering of the sharpness tend to be caused.

The turbidity of the each color toner is less than 60, preferably less than 50, and most preferably less than 40. The turbidity of the each color toner preferably exceeds 5. Besides, the largest difference of the turbidity among the color toners is from 5 to 45, and more preferably from 10 to 35.

In the invention, a group of toners composed of a black colored toner, a yellow colored toner, a magenta colored toner and a cyan colored toner is preferably used as the color toners. The character image and the color image with high sharpness and clearness can be formed by the use of such the four-color toners.

Among the color toners, the turbidity of the black toner is preferably less than 20. When the turbidity of the black toner is less than 20, the sharpness and the color reproducibility of both of the character image and the color image are difficultly degraded and good images can be stably formed.

In the color image, the toner having the largest turbidity is preferably the yellow colored toner. The yellow toner difficultly causes lowering of the sharpness and the hue even when the turbidity is made larger.

For controlling the turbidity of the toner according to the foregoing definition and the measuring method so as to be less than 60, and for controlling the largest difference of the turbidity among the toners so as to be from 5 to 45, it is necessary to suitable selection of the kind of the external additive to be adhered onto the toner surface and to control the adhering strength of the external additive particle, hereinafter simply referred to as the external additive, to the toner surface.

The number average particle diameter of the external additive preferably to be used in the invention is from 0.05 to 0.5 μm.

When the diameter of the external additive is smaller than 0.05 μm, the transferring ability is lowered since the physical adhesive force between the toner and the photoreceptor is not reduced. As a result of that the image density is lowered.

When the diameter exceeds 0.5 μm, the external additives once adhered to the toner particle is easily releases and made free by the tress caused by stirring in the developing means, and accumulated in the developing vessel. The accumulated external additive particles are re-aggregated in the developing vessel which acts as a nucleus and causes the lacking of toner transfer. Moreover, the filming tends to occur since many freed component particles are adhered onto the photoreceptor face.

The adding amount of the external additives is preferably from 0.05 to 5.0 parts by weight, and particularly preferable from 1.0 to 4.0 parts by weight, per 100 parts of the colored particles before the addition of the external additive. Hereinafter, the "part" means the "part by weight" unless a specific comment is attached.

When the adding amount is less than 0.05 parts, the transferring ability tends to be lowered since the effect of the lowering of the physical adhering force. When the adding amount exceeds 0.5 parts, the external additive particles tend to be easily released from the toner surface by the stress of stirring in the developing vessel since excessive external additive particles are at the toner surface. The released particles are accumulated in the developing vessel and re-aggregated. When the re-aggregated particle is mixed within the developed toner image, the aggregate acts as the nucleus and tends to cause the lacking of toner transfer. Moreover, the filming tends to occur since many freed component particles are adhered onto the photoreceptor face.

The method for controlling the adhering situation of the external additive to the colored particle is not limited and any externally adding device usually used for fine particles and any apparatus for fixing or adhering the fine particle onto the toner surface can be used.

Henschel mixer, Loedige Mixer and Turbo Sphere mixer can be used as the concrete apparatus for fixing the particles onto the toner surface. Among them, Henschel mixer is suitably used from the viewpoint of easiness of mixing, stirring and external heating. Moreover, the mixing and fixing of the external additive can be performed by the same apparatus in the case of Henschel mixer. The foregoing fixing treatment is preferably performed with a circumstance speed of the end of the stirring wing of from 5 to 50 m/s, and more preferably from 10 to 40 m/s. It is preferable that the external additive particles are uniformly adhered onto the toner particle surface by preliminary mixing. The temperature is preferably controlled at suitable temperature by externally heating by using warm water.

The temperature is measured at the flowing portion of the toner in the course of the stirring and mixing of the toner. It is preferably that the toner is cooled by passing cold water and crushed, after the fixing treatment.

For controlling the adhesive degree if the external additive to the colored particle surface, the colored particles and the external additive particles are mixed by stirring at a temperature of from Tg−20° C. to Tg+20° C. while application mechanical impact and the time for mixing is optionally controlled. Thus the external additive particles can be uniformly adhered to the colored particle surface.

The Tg is the glass transition point of the toner or the binder resin constituting the toner. The glass transition point is measured by a differential scanning calorimeter DSC7, manufactured by Parkin-Elmer Co., Ltd. The sample is heated from 0° C. to 200° C. in a rate of 10° C./min. and cooled from 200° C. to 0° C. in a rate of 10° C./min. for erasing the history, and then heated from 0° C. to 200° C. in a rate of 10° C./min. to determine the temperature of endothermic peak of the second heating. The temperature of the peak is determined as the Tg. When plural peaks are observed, the temperature of the principal peak is defined as the Tg.

The Tg of the toner or the binder resin constituting the toner is preferably from 40° C. to 70° C. When the Tg is lower than 40° C., the storage ability of the toner is inferior and the toner particles are aggregated. The Tg of higher than 70° C. is not desirable from the viewpoint of the fixing ability and the reducibility of the toner.

Additional external additive may be added after controlling the adhesion of the external additive from the viewpoint of the fluidity of the toner. In such the case, it is also necessary that the turbidity of the toner is within the range according to the invention.

The number average particle diameter of the external additive is observed by a transmission electron microscope and measured by an image analyzing apparatus.

An optional external additive may be used without any limitation.

For example, various kinds of inorganic oxide, nitride and boride are suitably usable. Example of the inorganic compound include silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, titanium carbide, silicon nitride, titanium nitride and boron nitride.

The foregoing inorganic external additive may be subjected to a hydrophobilizing treatment. When the hydrophobilizing treatment is applied, it is preferable that the treatment is performed by the use of a coupling agent such as various kinds of titanium coupling agent and silane coupling agent. Ones hydrophobilized by a metal salt of higher fatty acid such as aluminum stearate, zinc stearate and calcium stearate are also preferable.

When a resin external additive is used, the composition of the additive is not limited. Generally, as the external additive, a vinyl type organic external additive particle, a particle of a melamine-formaldehyde condensation product, polyester resin, a polycarbonate resin, a polyamide resin and a polyurethane resin are preferred since such the particles can be easily produced by a emulsion polymerization method or a suspension polymerization method.

The toner preferably to be used in the invention is described bellow.

The particle size of the toner according to the invention is preferably from 3 to 8 μm in the number average particle diameter. When the toner particles are prepared by a polymerization method, the particle diameter can be controlled according to the concentration the aggregating agent, the adding amount of the organic solvent, the time for aggregation and the composition of the resin it self in the later-mentioned production method of the toner.

When the number average diameter of the toner particles is from 3 to 8 μm, the fine toner particles, which have high adhesion force and causes filming by adhesion to the photoreceptor, are decreased so that the transferring efficiency of the toner is raised. As a result of that, the quality of halftone is improved and the quality of a fine line and dot is raised.

Regarding the particle size distribution of the toner, it is preferable that the sum M of the relative frequency $m_1$ of toner particles included in the highest frequent class and the relative frequency of the toner particles $m_2$ included in the next frequent class is not less than 70% in a histogram showing the distribution of number based particle diameter classified in to plural classes at intervals of 0.23 on the horizontal axis of natural logarithm ln D, D is the diameter of the toner particle in μm.

In the toner in which the sum of the relative frequency $m_1$ and the relative frequency $m_2$ is not less than 70%, the width of the particle size distribution is narrow. Accordingly, the primary and secondary transfer of the toner image can be improved and the occurrence of selective development can be certainly inhibited.

In the invention, the histogram of the number based particle size distribution is a histogram illustrating the particle size distribution based on the particle number classified into plural classes according to every 0.23 of natural logarithm ln D of the diameter of the individual toner particle, namely, 0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76 . . . . The histogram is prepared by measuring the particle diameter of the sample measured by Coulter Multisizer under the following conditions. The measured data are transferred to a computer through an I/O unit and the histogram is prepared according to a particle size distribution analyzing program by the computer.

Measuring Condition (1) Aperture: 100 μm (2) Sample preparation: A suitable amount of a surfactant (neutral detergent) is added to 50 to 100 ml of an electrolyte solution Isoton R-11, produced by Coulter Scientific Japan Co., Ltd., and stirred. Into the mixture, 10 to 20 mg of the sample to be measured is added and dispersed by an ultrasonic dispersing apparatus for 1 minute to prepare the sample liquid.

The particle diameter of the toner to be used in the invention is preferably from 3 to 8 μm in volume average diameter. The volume average diameter and the particle size distribution of the toner can be measured by Coulter Counter TA-II, Coulter Multisizer or a laser diffraction particle diameter measuring apparatus SLAD1100 manufactured by Shimadzu Seisakusho Co., Ltd. In the case of the use of Coultar Counter TA-II and Coulter Multisizer, the particle size distribution within the range of from 2.0 to 40 μm is measured using an aperture having a diameter of 100 μm.

There is no limitation on the production method of the toner. However, a polymerization toner or polymer toner is preferable since the production method of the polymer is simple and the toner is superior to a crashed toner in the uniformity.

The polymerized toner is a toner produced by a process for polymerizing a monomer to prepare the toner binder resin, a process for making the shape of the toner particle, and a process for a chemical treatment to be applied thereafter. In concrete, the toner is prepared by polymerization reaction such as suspension polymerization and emulsion polymerization and an aggregation process for aggregating the particles with each other carried out after the polymerization. By the polymerization method the toner having uniform particle size and shape can be obtained since the monomer is uniformly dispersed in an aqueous medium and then polymerized in such the method.

The objects of the invention can be attained any toner either one prepared by the crushing method or the polymerization method as long as the toner satisfies the requirements of the invention.

<Constitution and Producing Method of the Toner to be Used in the Invention>

The toner to be used in the invention may be produced by the most usually applied crushing method by which a binder resin, a colorant, and an additive according to necessity are kneaded, crushed and classified, or a method by which resin particle containing a mold-releasing agent and a colorant is synthesized in a medium.

Examples of the method for adhering by fusion the resin particles with together in an aqueous medium include those described in JP O.P.I. Publication Nos. 63-186253, 63-282749 and 7-146583, and a method by which the resin particles are adhered by fusion while the particles are salted out.

The weight average diameter of the particles is preferably from 50 to 2,000 μm. The resin particles may be prepared by any particle forming polymerization method such as an emulsion polymerization method, a suspension polymerization method and a seed polymerization method, and the emulsion polymerization method is preferably applied.

Usually known polymerizable monomers may be used for producing the resin in any producing method. The monomers may be used solely or in a combination of two or more kinds.

The binder resin is not specifically limited and usually known resin such as a styrene resin, an acryl resin, a styrene-acryl resin, a polyester resin, a styrene-butadiene resin and an epoxy resin are usable.

Examples of the monomer constituting the styrene resin, acryl resin or the styrene-acryl resin include styrene and its derivative such as styrene, o-methylstyrene, m-methyl styrene, p-methylstyrene, p-chlorostyrene, 3,4-dichlorostyrene, p-phenylstyrene, p-ethylstyrene, 2,4-dimethylstyrene, p-butylstyrene, p-n-hexylstyrene, p-n-octylstyrene, p-n-nonylstyrene, p-n-decylstyrene and p-n-dodecylstyrene; and a methacrylate derivative such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate; and an acrylate derivative such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, dimethylaminoethyl acrylate and diethylaminoethyl acrylate. These monomers may be used solely or in a combination of two or more.

As the concrete vinyl monomers, the followings are exemplified, an olefin compound such as ethylene, propylene and isobutylene; a halogenized vinyl compound such as vinyl chloride, vinylidene chloride, vinyl bromide, vinyl fluoride and vinylidene fluoride; a vinyl ester compound such as vinyl propionate, vinyl acetate and vinyl benzoate; a vinyl ether compound such as vinyl methyl ether and vinyl ethyl ether; a vinyl ketone such as vinyl methyl ketone, vinyl ethyl ketone and vinyl hexyl ketone; an N-vinyl compound such as N-vinylcarbazole, N-vinylindole and N-vinylpyrrolydone; a vinyl compound such as vinylnaphthalene and vinylpyridine; and an acrylic and methacrylic derivative such as acrylonitrile, methacrylonitrile, acrylamide, N-butylacrylamide, N,N-dibutylacrylamide, methacrylamide, N-butylmethacrylamide and N-octadecylacrylamide. These vinyl monomers may be used solely or in a combination of two or more.

Concrete examples of monomer for obtaining a carboxylic acid-containing styrene-acryl resin (vinyl resin) include acrylic acid, methacrylic acid, α-ethylacrylic acid, fumalic acid, maleic acid, itaconic acid, cinnamic acid, monobutyl maleate, monooctyl maleate, cinnamic anhydride, and half methyl ester of an alkenylsuccinic acid.

A crosslinking agent such as divinylbenzne, diethylene glycol dimethacrylate, triethylene glycol diacrylate, ethylene glycol dimethacrylate, diethylene glycol dimethacrylate and triethylene glycol dimethacrylate may be added.

The polyester resin is a resin obtained by condensation-polymerization of a di- or more-valent carboxylic acid and a di- or more-valent alcohol component. Examples of the di- or more-valent carboxylic acid include maleic acid, fumalic acid, citraconic acid, itaconic acid, glutaconic acid, phthalic acid, isophthalic acid, terephthalic acid, succinic acid, adipic acid, sebacic acid, azelaic acid, malonic acid, n-dodecylsuccinic acid, n-dodecenylsuccinic acid, isododecylsuccinic acid, nooctylsuccinic acid and n-octenyl acid. Acid anhydride of these acids also may be used.

Examples of the di-valent alcohol component constituting the polyester resin include an etherized bis-phenol such as polyoxypropylene(2.2)-2,2-bis(4-hydroxyphenyl)propane, polyoxypropylene(3.3)-2,2-bis(4-hydroxyphenyl)propane, polyoxypropylene(2.0)-2,2-bis(4-hydroxyphenyl)propane, polyoxypropylene-(2.0)-polyoxyethylene(2.0)-2,2-bis(4-hydroxyphenyl)propane and polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, 1,4-butenediol, neopentyl glycol, 1,5-pentane glycol, 1,6-hexane glycol, 1,4-cyclohexanedimethanol, dipropylene glycol, polyethylene glycol, polypropylene glycol, polytetramethylene glycol, bis-phenol A, bis-phenol Z and hydrogenated bis-phenol A.

Examples of monomer for the polyester resin having a crosslinking structure include a tri- or more-value carboxylic acid such as 1,2,4,-benzenetricarboxylic acid, 2,5,7-naphthalentricarboylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid and empol-trimer acid, and their anhydride compounds. The crosslinked polyester resin can be also prepared by adding a polyvalent-alcohol such as sorbitol, 1,2,3,6-hexanetetrol, 1,4-sorbitol, pentaerythrytol, dipentaerythritol, 1,2,4-butantriol, 1,2,5-pentatriol, glycerol, 2-methylpropanetriol, 2-methyl-1,2,4-pentatriol, trimethylolethane, trimrthylolpropane and 1,3,5-trihydroxymethylbenzene.

In the invention, an inorganic pigment and an organic pigment can be used as the colorant to be used in the black colored toner, hereinafter also referred to as Toner Bk, the yellow colored toner, hereinafter also referred to as Toner Y, the magenta colored toner, hereinafter also referred to as Toner M, or the cyan colored toner, hereinafter also referred to as Toner C.

Known inorganic pigments may be used. Concrete examples of the inorganic pigment are shown below.

As the black pigment, for example, carbon black such as furnace black, channel black, acetylene black, thermal black and lamp black, and a magnetic powder such as magnetite and ferrite are usable.

These inorganic pigments may be used solely or in a combination of plural kinds. The adding amount of the pigment is from 2 to 20%, and preferably from 3 to 15%, by weight of the polymer.

When the toner is used as a magnetic toner, the magnetite can be added. In such the case, the magnetite is preferably added in a ratio of from 20 to 60% by weight for giving the required magnetic properties.

Known organic pigments can be used. Concrete examples of the organic pigment are listed below.

Examples of the magenta or red pigment include C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178 and C. I. Pigment Red 222.

Examples of the yellow pigment include C. I. Pigment Orange 31, C. I. Pigment Orange 43, C. I. Pigment Yellow 12, C.I. Pigment Yellow 13, C. I. Pigment Yellow14, C. I. Pigment Yellow 15, C. I. Pigment Yellow 17, C. I. Pigment Yellow 93, C. I. Pigment Yellow 94 and C. I. Pigment Yellow 138.

Examples of the cyan pigment include C. I. Pigment Blue 15, C. I. Pigment Blue 15:2, C. I. Pigment Blue 15:3, C. I. Pigment Blue 16, C. I. Pigment Blue 60 and C. I. Pigment Green 7.

These organic pigments may be used solely or in a combination of plural kinds. The adding amount of the pigment is from 2 to 20%, and preferably from 3 to 15%, by weight of the polymer.

The colorant also may be used after the surface modification. Known surface modifying agents may be used for such the modification. In concrete, a silane coupling agent, a titanium coupling agent and an aluminum coupling agent are preferably used.

A material so called external additive may be added into the toner according to the invention for improving the fluidity and the fixing ability. As above-mentioned, various kinds of organic particle, organic particle and lubricant may be used as the external additive without any limitation.

Other than the foregoing external additives, a lubricant may be added as an external additive. The examples of the lubricant include a metal salt of higher fatty acid such as stearate of zinc, aluminum, copper, magnesium or calcium, oleate of zinc, manganese, iron, copper or magnesium, palmitate of zinc, copper, magnesium or calcium, linolate of zinc or calcium and ricinolate of zinc or calcium.

The adding amount of such the lubricant is preferably from 0.1 to 5% by weight of the toner. In the toner making process, the foregoing external additives may be added for the purposes such as the improvement of the fluidity, charging property and cleaning suitability. Various known mixing means such as a tabular mixer, Henschel mixer, Nauter mixer and V-type mixer can be used for addition the external additive.

A material other than the binder resin and the colorant may be added to the toner to give various functions to the toner. In concrete, a mold-releasing agent and charge controlling agent are usable.

As the mold-releasing agent, various known compound, for example, an olefin wax such as polypropylene and polyethylene and a modified product thereof, a natural wax such as carnauba wax and rice wax, and an amide wax such as a fatty acid bis-amide are usable. As above described, it is preferred that the compound is added in a form of mold-releasing particles and adhered by fusion together with the resin and the colorant.

Known charge controlling agents dispersible in water can be used. Concretely, a nigorsin dye, a metal salt of naphthenic acid or a higher fatty acid, an alcoxylated amine, a quaternary ammonium chloride, an azo-complex of metal and a metal salicylate and a metal complex thereof are exemplified.

<Developer>

The toner according to the invention may be preferably applied to a two-component developer even though it may be applied to either to a single-component developer or a two-component developer.

When the toner is used as the single-component developer, the toner is usually used as a magnetic developer by adding the magnetic particle with a size of from 0.1 to 5 μm into the toner particle even though the intact toner may be used as a non-magnetic single-component developer. It is usual that the magnetic particle is added into a non-spherical particle in the same manner as the addition of the colorant.

The toner particle can be used as the two-component developer by mixing with a carrier. In such the case, known materials, for example, a metal or metal oxide such as iron, ferrite and magnetite, an alloy of such the metal with another metal such as aluminum and lead are usable as the magnetic particle of the carrier. The ferrite particle is particularly preferred. The volume average diameter of the magnetic particles is from 15 to 100 μm, and preferably from 25 to 60 μm.

The volume average particle diameter of the magnetic particles can be typically measured by a laser diffraction particle size distribution measuring apparatus having a wet dispersing device HELOS manufactured by Sympatec Co., Ltd.

As the carrier, a resin dispersion type carrier is preferred, in which the magnetic particle is coated with a resin or the particle is dispersed in the resin. An olefin resin, a styrene resin, a styrene-acryl resin, a silicone resin, an ester resin and a fluororesin are usable as the coating resin, even though the resin is not specifically limited. Known resins are usable as the resin for constituting the resin dispersion type carrier without any limitation. For example, a styrene-acryl resin, a polyester resin, a fluororesin and a phenol resin may be used.

The photoreceptor to be used in the invention is described in detail bellow.

As the electrophotographic photoreceptor to be used in the image forming apparatus according to the invention, an organic photoreceptor is preferable from the viewpoint of the sensitivity to laser light and the reproducibility thereof, even though either an inorganic or organic photoreceptor can be used.

The organic photoreceptor is a photoreceptor in which at least one of the charge generation function and the charge transfer function, each essential for constituting the electrophotographic photoreceptor, is allocated to an organic compound, and wholly includes a photoreceptor constituted by a known organic charge generation substance or a known organic charge transfer substance, and a photoreceptor in which the charge generation function and the charge transfer function are constituted by a polymer complex.

It is preferable that the surface of the electrophotographic photoreceptor to be used in the image forming apparatus according to the invention is made a condition of lowered surface energy for improving the transferring ability of the toner from the photoreceptor to the intermediate transferring member. One of the measures for such the problem is to make the surface of the photoreceptor by a layer containing a fluororesin particle. Another one of the measures is to supply a surface energy reducing agent to the photoreceptor surface. Thus the surface energy of the photoreceptor can be lowered to improve the transferring ability of the toner from the photoreceptor to the intermediate transferring member. By applying the combination of such the lowering of the surface energy and the use of the group of toners each having controlled turbidity, the transferring efficiency of both of the primary and secondary transfer of the toner can be raised and a color electrophotographic image having high sharpness of the character image and the color image and good color reproducibility can be obtained by the synergistic effect of the measures.

In the electrophotographic photoreceptor according to the invention, it is preferable to make the contact angle of the surface layer to water is not less than 90° C. by lowering the surface energy. The cleaning ability of the toner is improved together with the improvement of the transfer ability of the toner from the photoreceptor to the intermediate transferring member.

Examples of the foregoing fluororesin particle include a particle of polytetrafluoroethylene, poly(vinylidene fluoride), poly(ethylene trifluoride), Poly(vinyl fluoride), a copolymer of ethylene tetrafluoride/perfluoroalkylvinyl ether, a copolymer of tetraethylene/ropropylene hexafluoride, a copolymer of ethylene/ethylene trifluoride, and a copolymer of ethylene tetrafluoride/propylene hexafluoride/perfluoroalkyl vinyl ether. The size of the particle is preferably from 0.05 to 10 μm, and more preferably from 0.1 to 5 μm, by volume average diameter. The amount of the fluororesin particles contained in the photoreceptor according to the invention is preferably from 0.1 to 90%, and more preferably from 1 to 50%, by weight of the binder of the surface layer. When the amount is less than 0.1%, sufficient durability and lubricity can not be provided to the photoreceptor, therefore, the improvement of the primary transferring ability of the toner is made little, and the lowering of the image density, lacking of the transfer and degrading of the sharpness tend to occur. When the amount exceeds 90% by weight, the formation of the surface layer tends to be difficult.

The volume average diameter of the fluororesin particles is measured by a laser diffraction/scatter type particle size distribution measuring apparatus LA-700, manufactured by Horiba Seisakusho Co., Ltd. The contact angle of the photoreceptor surface to water is measured by a contact angle meter CA-DT-A, manufactured by Kyowa Kaimen Kagaku Co., Ltd., at a temperature of 20° C. and a relative humidity of 50%.

The surface energy reducing agent is described below.

The surface energy reducing agent is a substance reducing the surface energy of the electrophotographic photoreceptor surface when it is adhered to the surface. In concrete, the substance by which the contact angle of the electrophotographic photoreceptor to purified water is increased to 1° or more when the substance is adhered to the surface.

A metal salt of fatty acid is usable as the surface energy reducing agent. The surface energy reducing agent is not limited to the fatty acid metal salts and any materials are usable as long as the material can increase the contact angle of the surface of the electrophotographic photoreceptor to 1° or more.

As the surface energy reducing agent to be used in the invention, the fatty acid metal salts are most preferable which suitably has a scattering ability and a uniform layer forming ability on the surface of the photoreceptor. A salt saturated or unsaturated fatty acid having 10 or more carbon atoms is preferred. Examples of such the compound include aluminum stearate, indium stearate, gallium stearate, zinc stearate, lithium stearate, magnesium stearate, sodium stearate, aluminum palmitate and aluminum oleate. Metal stearates are more preferable.

Among the foregoing fatty acid salts, ones showing high flowing speed in a flow tester have high cleaving ability and are capable of effectively forming the layer of the fatty acid salt on the surface of the electrophotographic photoreceptor according to the invention. The flowing speed is preferably from $1\times10^{-7}$ to $1\times10^{-1}$, and most preferable from $5\times10^{-4}$ to $1\times10^{-2}$. The flowing speed is measured by a flow tester CFT-500, manufactured by Shimadzu Seisakusho CO., Ltd.

FIG. 1 is a cross section of the color image forming apparatus illustrating an embodiment of the invention.

The color image forming apparatus is one so called as a tandem type color image forming apparatus, in which plural image forming units 10Y, 10M, 10C and 10Bk, an endless belt-shaped intermediate transferring unit 7, a paper conveying means 21 and a fixing means 24 are equipped. An original image reading device 5C is arranged at the upper portion of the main body of the image forming apparatus.

The image forming unit 10Y for forming a yellow colored image has a drum-shaped photoreceptor 1Y as a primary image carrier, and a charging means 2Y, exposing means 3Y, developing means 4Y, a primary transferring roller 5Y as a primary transferring means and a cleaning means 6Y which are arranged around the photoreceptor 1Y. The image forming unit 10M for forming a magenta colored image has a drum-shaped photoreceptor 1M, and a charging means 2M, exposing means 3M, developing means 4M, a primary transferring roller 5M as a primary transferring means and a cleaning means 6M. The image forming unit 10C for forming a cyan colored image has a drum-shaped photoreceptor 1C, and a charging means 2C, exposing means 3C, developing means 4C, a primary transferring roller 5C as a primary transferring means and a cleaning means 6C. The image forming unit 10Bk for forming a black colored image has a drum-shaped photoreceptor 1Bk, and a charging means 2Bk, exposing means 3Bk, developing means 4Bk, a primary transferring roller 5Bk as a primary transferring means and a cleaning means 6Bk.

The endless belt-shaped intermediate transferring unit 7 has an endless belt-shaped intermediate transferring member 70 as a secondary image carrier which is wound on plural rollers and circulatably held.

In the image forming apparatus according to the invention, an image exactly corresponding to the exposed spot area can be obtained by the use of the toner satisfying the requirements of the invention even when the imagewise exposure by the foregoing exposure means is performed by a small diameter light beam such as the spot area of not more than 2.000 $\mu m^2$. A spot area of from 100 to 800 $\mu m^2$ is more preferable. As a result of that, an electrophotographic image of an image density of 800 dpi (dpi is number of dot per 2.54 cm) can be formed which has high reproducibility of character image, halftone image and high sharpness and has no occurrence of the lacking of toner transfer and formation of black spot.

The spot area of the exposure beam is an area corresponding to the region of the light intensity distribution in which the light intensity is not less than $1/e^2$ of the maximum intensity, at the surface of the cross section of the light beam formed by cutting the light beam by a perpendicular face.

The exposure beam includes that generated by a scanning optical system using a semiconductor laser and a solid scanner using a LED and a liquid crystal shutter, and the light intensity distribution includes Gauss distribution and Lorentz distribution, and the spot area is defined by the area of the light intensity of $1/e^2$ of the maximum peak intensity in each of the distribution.

Color images formed in the image forming units 10Y, 10M, 10C and 10Bk, respectively, are successively transferred onto the circulating endless belt-shaped intermediate transferring member 70 by the primary transferring rollers 5Y, 5M, 5C and 5Bk as the primary transferring means, thus a color image is synthesized. Paper P as a recording material (a support carrying the finally fixed image such as a plain paper sheet and a transparent sheet) stocked in a paper supplying cassette 20 is supplied by a paper supplying means 21, and conveyed to a secondary transferring roller 5A as a secondary transferring means through intermediate conveying rollers 22A, 22B, 22C and 22D and a register roller 23. Then the color image is collectively transferred by the secondary transferring onto the paper P. The color image transferred on the paper P is fixed by the fixing means 24 and conveyed by an output roller 25 to be stood on an output tray 26.

Besides, the toner remained on the endless belt intermediate transferring member 70 is removed by the cleaning means 6A after the color image is transferred to the paper P by the secondary transferring roller 5A and the paper P is separated by curvature from the intermediate transferring belt.

In the course of the image formation process, the primary transferring roller 5Bk is constantly pressed to the photoreceptor 1Bk. The other primary transferring rollers 5Y, 5M and 5C are each contacted by pressing to the corresponding photoreceptors 5Y, 5M and 5C, respectively, only for the period of image formation.

The secondary transferring roller 5A is contacted by pressing to the endless belt-shaped intermediate transferring member 70 only for the period of the secondary transferring while passing of the paper P.

A box 8 can be pulled out from the main body A of the apparatus through supporting rails 82L and 82R.

The box 8 includes the image forming units 10Y, 10M, 10C and 10Bk, and the endless belt-shaped intermediate transferring unit 7.

The image forming units 10Y, 10M, 10C and 10Bk are serially arranged in the perpendicular direction. In the drawing, the endless belt-shaped intermediate transferring unit 7 is arranged at left side of the photoreceptors 1Y, 1M, 1C and 1Bk. The endless belt-shaped intermediate transferring unit 7 included the circulatable endless belt-shaped intermediate transferring member 70 wound with the rollers 71, 72, 73 and 74, the primary transferring rollers 5Y, 5M, 5C and 5Bk, and the cleaning means 6A.

Figure 2:
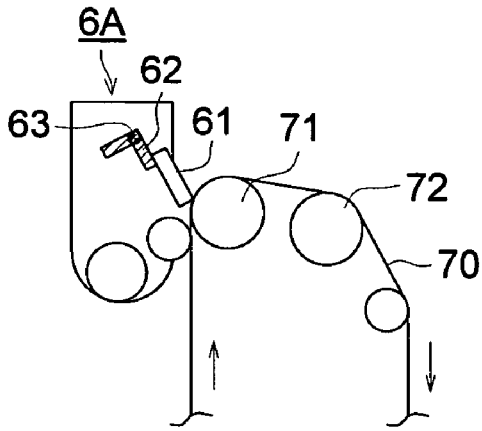
FIG. 2 shows an example of cleaning means of intermediate transferring member.

FIG. 2 illustrates an example of the cleaning means for the intermediate transferring member.

As is shown in FIG. 2, the cleaning means 6A for the intermediate transferring member is constituted by a blade 61 which is equipped to a bracket 62 which is rotatably controlled around a supporting shaft 63. The blade pressing force to the roller 71 can be controlled by varying the load by a spring or a weight.

The image forming units 10Y, 10M, 10C and 10Bk are pulled out from the main body A together with the endless belt-shaped intermediate transferring unit 7 when the box 8 is pulled out.

The supporting rail 82L equipped at the left side of box 8 in the drawing is positioned in the space at the upper portion of the fixing means 24. The supporting rail 82R equipped at the right side of box 8 in the drawing is arranged at the lower portion of the lowest developing means 4Bk. The supporting rail 82R is positioned so as to not obstruct the action to the developing means 4Y, 4M, 4C and 4Bk for installing into and releasing out from the box 8.

In the drawing, the right side of the photoreceptors 1Y, 1M, 1C and 1Bk is surrounded by the developing means 4Y, 4M, 4C and 4Bk, the lower portion is surrounded by the charging means 2Y, 2M, 2C and 2Bk, and the light side portion is surrounded by the endless belt-shaped intermediate transferring member 70.

In the box 8, the photoreceptor and the charging means constitute the photoreceptor unit, and one developing means and the toner supplying device constitute one developing unit.

Figure 3:
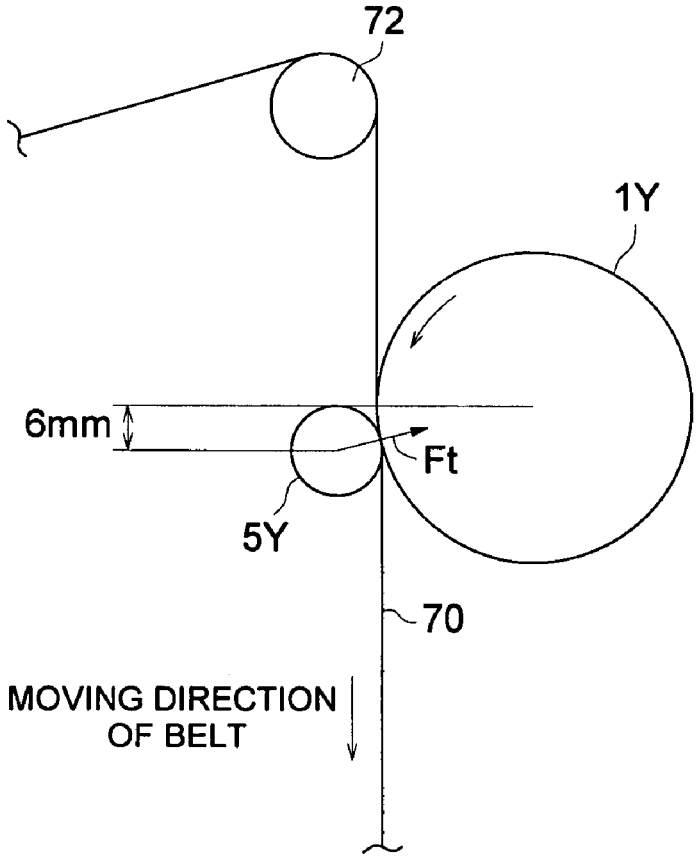
FIG. 3 shows the relational positions of a photoreceptor, an endless belt type intermediate transferring member and a primary transferring roller.

FIG. 3 is a drawing of the arrangement illustrating the relation of the positions of the endless belt-shaped intermediate transferring member and the primary transferring rollers. As is shown in FIG. 3, the primary transferring rollers 5Y, 5M, 5C and 5Bk each pushes the endless belt-shaped intermediate transferring member 70 as the intermediate transferring means from the back side to contact to photoreceptors 1Y, 1M, 1C and 1Bk, respectively. The primary transferring rollers 5Y, 5M, 5C and 5Bk are each arranged at the position being at the lower course side of each of the contact points of the photoreceptors 1Y, 1M, 1C and 1Bk with the endless belt-shaped intermediate transferring member 70, respectively, when the pressure is not applied. When the primary transferring rollers 5Y, 5M, 5C and 5Bk are each contacted by applying pressure to the photoreceptors 1Y, 1M, 1C and 1Bk, the endless belt-shaped intermediate transferring member 70 is curved along the circumference of each of the photoreceptors 1Y, 1M, 1C and 1Bk. Therefore, the primary transferring rollers 5Y, 5M, 5C and 5Bk are arranged at the lowest course of the contacting area of the endless belt-shaped intermediate transferring member 70 with the photoreceptor.

Figure 4:
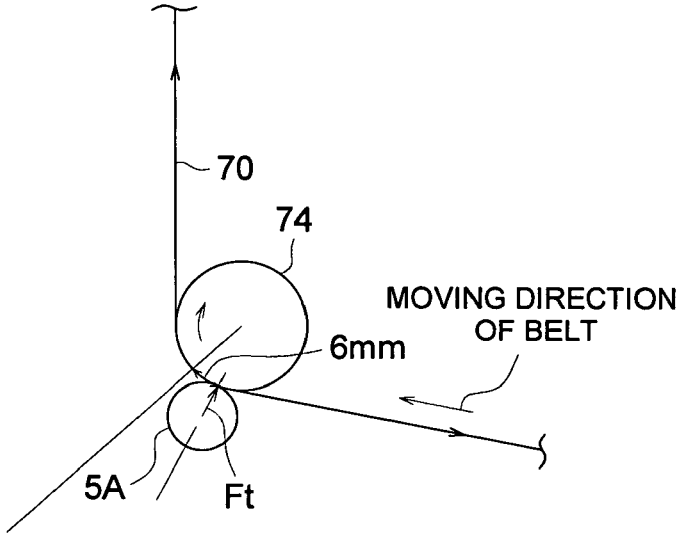
FIG. 4 shows the relational positions of a photoreceptor, an endless belt type intermediate transferring member and a secondary transferring roller.

FIG. 4 is a drawing of the arrangement illustrating the relation of the positions of the backup rollers, the endless belt-shaped intermediate transferring member and the secondary transferring roller. It is preferable that the secondary transferring roller 5A is arranged at a position being at upper course side of the rotating direction of the backup roller than the center portion of the contact area of the endless belt-shaped intermediate transferring member 70 with the backup roller on the occasion of that the pressure is not applied, as is shown in FIG. 4.

A film of polymer such as polyimide, polycarbonate and PVdF and a synthesized rubber such as silicone rubber and fluorized rubber which are given electric conductivity by addition of electroconductive filler such as carbon black are usable for the intermediate transferring member. The shape of the intermediate transferring member may be either drum or belt, and the belt-shaped one is preferred from the viewpoint of the degree of freedom of the apparatus design.

It is preferable that the surface of the intermediate transferring member is suitably roughened. By making the ten point surface roughness Rz or the intermediate transferring member to 0.5 to 2 μm, it is made possible that the surface energy reducing agent supplied is taken to the surface of the intermediate transferring member so as to lower the adhesive force of the toner on the surface of the intermediate transferring member. Thus the efficiency of the secondary transfer of the toner from the intermediate transferring member to the recording material can be easily raised. In such the case, such the effect tends to be enhanced when the ten point surface roughness Rz of the intermediate transferring member is larger than that of the photoreceptor.

Figure 6:
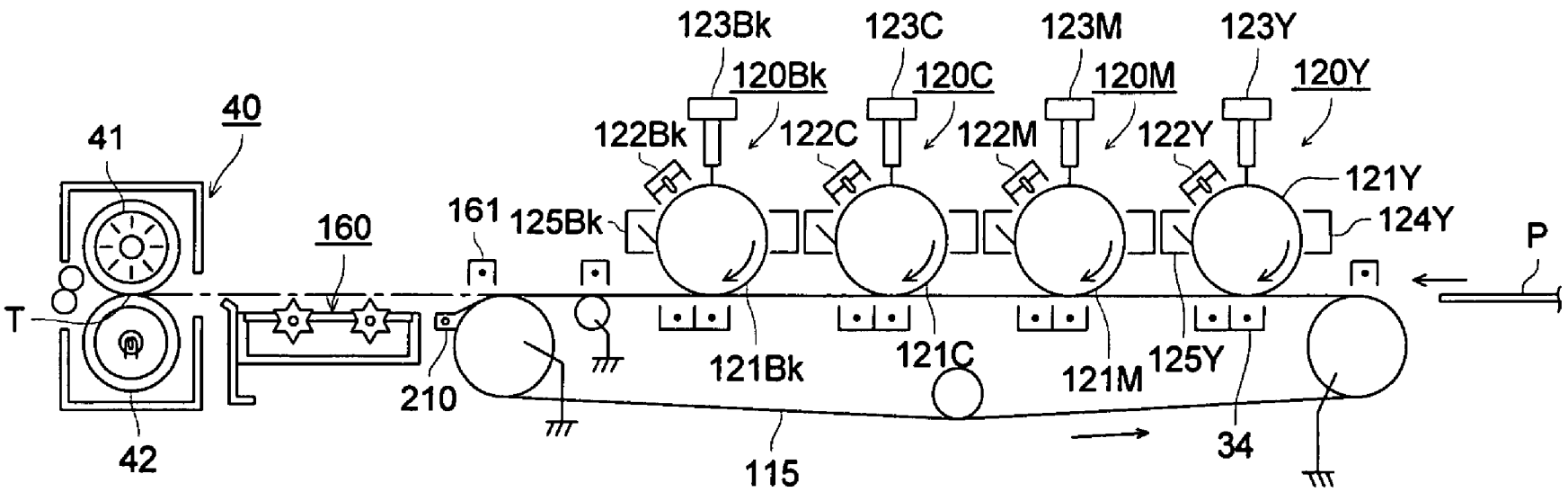
FIG. 6 shows a cross section of the constitution of an image forming apparatus for forming a color image showing an embodiment of the invention.

FIG. 6 shows a cross section of the constitution of an image forming apparatus capable of forming a color image as an embodiment of the invention.

In the image forming apparatus shown in FIG. 6, four image forming units 120Y, 120M, 120C and 120Bk are arranged along a transferring belt or recording material conveying belt 115.

The image forming units are each constituted by photoreceptor drums 121Y, 121M, 121C and 121Bk, scorotron charging devices or charging means 122Y, 122M, 122C and 122Bk, exposing devices or exposing means 123Y, 123M, 123C and 123Bk developing devices or developing means 124Y, 124M, 124C and 124Bk, and cleaning devices or cleaning means 125Y, 125M, 125C and 125Bk, respectively, and the toner images each formed on the photoreceptor drums 121Y, 121M, 121C and 121Bk are successively transferred and piled up onto a recording paper P (toner image receiving member) such as plain paper and a transparency sheet, which is synchronously conveyed, by a transferring devices or transferring means 134Y, 134M, 134C and 134Bk to form a color toner image.

The recording material is conveyed by a transferring belt 115 and then separated from the conveying belt by the chage removing effect of an AC charge removing device for paper separation 161 and a separation claw 210 which is equipped in the conveying zone 160.

Then the recording material P is conveyed to a fixing device or fixing means 40 through the conveying zone 160, the fixing means is constituted by heating roller 41 and pressing roller 42. The recording material is inserted into the nip T formed by the heating roller and the pressing roller and the toner image is fixed by applying heat and pressure. Then the recording material is output from the apparatus.

In the exposure means, a scanning optical system or a solid state scanner composed of a LED and a solid shutter may be used as the light source.

For the transferring belt 115 conveying the recording material, a film of polymer such as polyimide, polycarbonate and PVdF and a synthesized rubber such as silicone rubber and fluorized rubber which are given electric conductivity by adding electroconductive filler such as carbon black are usable. The shape of the intermediate transferring member may be either drum or belt, and the belt-shaped one is preferred from the viewpoint of the degree of freedom of the apparatus design.

It is preferable that the surface of the intermediate transferring member is suitably roughened. By making the ten point surface roughness Rz or the intermediate transferring member to 0.5 to 2 μm, the contactness between the recording material and the transferring belt is raised, and the quaking of the recording material on the conveying belt can be inhibited. Thus the transfer of the toner image from the photoreceptor to the recording material is improved.

In the invention, the latent image formed on the electrophotographic photoreceptor is developed to actualize as the toner image while supplying a surface energy reducing agent to the surface of the photoreceptor. For supplying the surface energy reducing agent to the photoreceptor, a method may be applied by which the surface energy reducing agent is mixed with the developer and is supplied to the photoreceptor through the developer. However, another method is preferably applied in the invention. Namely, the sufficient amount of the surface reducing agent is difficultly mixed with the toner since the agent influences on developing ability such as the charging property and the fluidity of the toner. In the case of the toner according to the invention, the inhibiting effects on the toner transfer lacking and the character image scattering are considerably degraded by the mixing of the surface reducing agent with the develper. Therefore, the use of the following method is preferred which is different from the method of mixing with developer.

In the invention, it is preferable that the image forming apparatus has a surface energy reducing agent supplying means for supplying the surface energy reducing agent to the surface of the electrophotographic photoreceptor. The agent supplying means may be quipped at a suitable position near the electrophotographic photoreceptor. The agent supplying means may be equipped applying a part of the charging means, the developing means and the cleaning means for effectively utilizing the space for set up space. For example, the agent supplying means is equipped together with the cleaning means.

Figure 5:
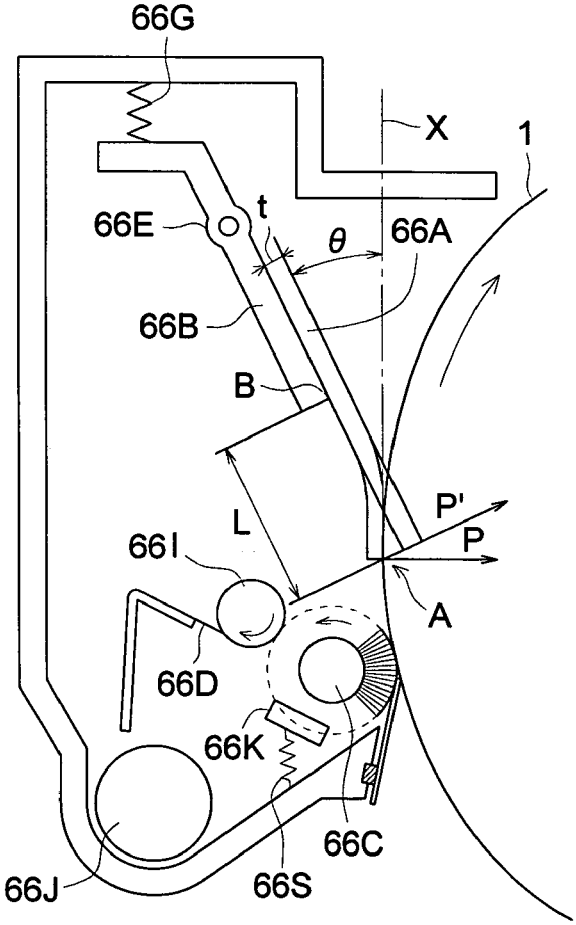
FIG. 5 shows the constitution of cleaning means to be installed with the photoreceptor according to the invention.

FIG. 5 shows the constitution of the cleaning means to be equipped with the photoreceptor. The cleaning means is used as the cleaning means of 6Y, 6M, 6C and 6Bk of FIG. 1 and 125Y, 125M, 125C and 125Bk of FIG. 6.

As is shown in FIG. 5, a cleaning blade 66A is attached with a supporting member 66B. The material of the cleaning blade is elastic rubber. As the material of cleaning means, urethane rubber, silicone rubber, fluorinated rubber, chloroprene rubber and butadiene rubber are known. Among them, urethane rubber is particularly preferable since it is superior in the abrasion resistivity.

The supporting member 66B is constituted by metal parts or plastic parts. The metal parts are preferably made from a stainless steel plate, aluminum plate or a quake-inhibited steel plate.

In the invention, the end portion of the cleaning blade contacted to the photoreceptor surface by pressure is preferably contacted under the condition of loaded in the reversal direction to the direction of the rotation of the photoreceptor. It is preferable that the end portion of the blade is contacted by pressure to the photoreceptor so as to form as contacting face.

Preferable values of the contacting load P and the contacting angle θ to the photoreceptor surface are each from 5 to 40 N/m and 5 to 35°, respectively.

The contact load P is the value of vector in the normal line direction of the contact pressure force P' when the cleaning blade 66A is contacted to the photoreceptor drum.

The contacting angle θ is an angle of tangent line X at the contacting point A with the blade before deformation (shown by broken line in the drawing). 66E is a rotating axis to rotatably hold the supporting member and 66G is a loading spring.

The free length L of the cleaning blade is the distance from the end point B of the supporting member to the end point of the blade before deformation as is illustrated in FIG. 5. The free length L is preferably from 6 to 15 mm. The thickness of the blade t is preferably from 0.5 to 10 mm. In the invention, the thickness of the blade is a thickness in the perpendicular direction to the fixing surface of the supporting member 66B as is shown in FIG. 5.

In the cleaning means of FIG. 5, a brush roller 66C is installed which is also used as the agent supplying means. The brush roller has function of the agent supplying means for supplying the surface energy reducing agent to the photoreceptor together with the functions of removing the toner adhering on the photoreceptor and of recycling the toner removed by the cleaning blade 66A. The brush roller is contacted to the photoreceptor 1 and rotated at the contact portion in the same direction with the moving direction of the photoreceptor to remove the toner and paper powder on the photoreceptor, and further to convey the toner removed by the cleaning blade 66A and to recover into a conveying screw 66J. In the course of the above, it is preferable to remove the removed substance such as the toner transferred to the brush roller 66C by contacting a flicker 66I as a removing means for the brush roller 66C. The toner adhered to the flicker is removed by a scraper 66D and recovered into the conveying screw 66J. The recovered toner is taken out from the apparatus as wastes or returned to the developing device to reuse through a recycle pipe not shown in the drawing. As the material of the flicked 66I, a pipe of metal such as stainless steel and aluminum is preferably used. Besides, a plate of an elastic material such as phosphor bronze, polyethylene and polycarbonate is used for the material of the flicker 66I. The scraper is preferably contact in the counter direction so that the end of the flicker makes an acute angle with the rotating direction of the flicker.

The surface energy reducing agent 66K, a solid material such as zinc stearate, is attached so that the agent is contacted by pressure to the brush roller by a loading spring 66S. The brush scours off the surface energy reducing agent while rotating and supplies the agent to the surface of the photoreceptor.

As the brush roller 66C, a brush roller made from an electro-conductive or an electro semi-conductive material is used.

The material constituting the brush roller to be used in the invention is preferably a fiber formable polymer having hydrophilicity and high permittivity. Examples of such the polymer include rayon, nylon, polycarbonate, polyester, methacrylic acid resin, acryl resin, poly(vinyl chloride), poly(vinylidene chloride), polypropylene, polystyrene, poly (vinyl acetate), styrene-butadiene copolymer, vinylidene chloride-acrylonitrile copolymer, vinyl chloride-vinyl acetate copolymer, vinyl chloride-vinyl acetate-maleic anhydride copolymer, silicone resin, silicone-alkyd resin, phenol-formaldehyde resin, styrene-alkyd resin and polyvinyl acetal such as polyvinyl butyral. These resins may be used solely or in a combination of two or more kinds. Rayon, nylon, polyester, acryl resin and polypropylene are preferred.

An electroconductive or semi electroconductive brush is used as the foregoing brush and ones may be used, the electroconductivity of which is controlled so as to be an optional relative conductivity by adding a low resistivity material such as carbon into the brush constituting material.

The relative resistance of the brush fiber is preferably from $10^1$ Ωcm to $10^6$ Ωcm when the resistance is measured by applying 500 V to both ends of a fiber with a length of 10 cm under ordinary temperature and humidity, namely a temperature of 26° C. and a relative humidity of 50%.

The brush roller is preferably constituted by a stainless steel core and the electroconductive or semi-conductive fibers having a relative resistance of from $10^1$ Ωcm to $10^6$ Ωcm. When the relative resistance is lower than $10^1$ Ωcm, banding caused by discharge tends to occur. When the relative resistance is higher than $10^6$ Ωcm, the potential difference to the photoreceptor is lowered and cleaning is tends to be insufficient.

The thickness of the one brush fiber is preferably from 5 to 20 denier. When the thickness is lower than 5 denier, the material adhered to the surface cannot be removed since the scouring force is insufficient. When thickness exceeds 20 denier, the surface of the photoreceptor is damaged and the wearing is accelerated so as to short the life of the photoreceptor since the brush is made excessively hard.

The "denier" is defined by the weight in gram of 9,000 m of the fiber of the brush.

The density of the fiber of the brush, the number of the brush fiber per square centimeter, is from $4.5\times10^2/cm^2$ to $2\times10^4/cm^2$. When the density is lower than $4.5\times10^2/cm^2$, the hardness is low and the scouring force is too weak so that the unevenness of scouring occurs and the adhering substance cannot be uniformly removed. When the density is higher than $2\times10^4/cm^2$, the photoreceptor is worn and fogging caused by lowering of the sensitivity and the image defects such as black lines by damages occur since the brush is made excessively hard.

The sinking depth of the brush roller into the photoreceptor is preferably set at from 0.4 to 1.5 mm, and more preferably from 0.5 to 1.2 mm. The sinking depth means the load applied to the brush caused by the relative moving of the photoreceptor drum and the brush roller. Such the load is corresponding to the scouring force applied to the photoreceptor, and the limitation of the range of the thinking depth is means that it is necessary that the photoreceptor is scoured by suitable force.

The sinking depth is defined by the length of the brush fiber sunk into the photoreceptor assuming that the fiber of the brush is linearly sink into the photoreceptor without curving.

On the photoreceptor to which the surface energy reducing agent is supplied, the scouring force by the brush is weak. Accordingly, when the sinking depth is smaller than 0.4 mm, the filming on the photoreceptor surface by the toner of paper powder cannot be inhibited and image defects such as the unevenness of image density are caused. When the sinking depth is larger than 1.5 mm, the wearing amount of the photoreceptor is made larger since the wearing force is excessively large so that the fogging is caused by the lowering of the sensitivity, damages on the photoreceptor and the line-shaped image defect occur.

As the core material of the brush roller in the invention, metal such as stainless steel and aluminum, paper and plastics are principally used, but the material is not limited thereto.

The brush roller is preferably constituted by the cylindrical core and brush adhered to the core through an adhering layer.

The brush roller is preferably rotated so the portion of the brush touching to the photoreceptor is moved in the same direction as that of the surface of the photoreceptor. If the touching portion is moved in the reverse direction, the toner removed by the brush is fallen and contaminate the recording material of the apparatus sometimes when excessive toner is on the photoreceptor surface.

When the photoreceptor and the brush roller are moved in the same direction, the ratio of the surface speed of them is preferably from 1:1.1 to 1:2. When the rotating speed of the roller brush is slower than that of the photoreceptor, the cleaning tends to be insufficient since the toner removing ability of the brush roller is reduced. When the speed of the brush roller is higher than that of the photoreceptor, the toner removing ability is made excessive so that bounding or turning over of the blade tends to occur.

EXAMPLES

The embodiment of the invention is described in concrete below. However, the constitution of the invention is not limited thereto.

Preparation of Developer

Preparation of Toner and Developer

<Preparation of Toners 1Bk, 1Ya, 1Yb, 1M and 1C>

Into a vessel, 0.90 kg of sodium n-dodecylsulfate and 10.0 l of purified water were charged and dissolved by stirring. To the solution, 1.20 kg of carbon black Regal 330R, produced by Cabot Co., Ltd., is gradually added and sufficiently stirred for 1 hour, and then continuously dispersed for 20 hours by a sand grinder (medium using dispersing machine). Thus obtained was referred to as Colorant Dispersion 1.

A solution composed of 0.055 kg of sodium dodecylbenzenesulfonate and 4.0 l of ion-exchanged water was prepared. The solution was referred to as Anionic Surfactant Solution A.

A solution composed of 0.014 kg of a nonylphenol polyethylene oxide adduct (10 moles adduct) and 4.0 l of ion-exchanged water was prepared. The solution was referred to as Nonionic Surfactant Solution B.

A solution composed of 223.8 g of potassium persulfate and 12.0 l of ion-exchanged water was prepared. The solution was referred to as Initiator Solution C.

Into a glass lining reaction vessel with a volume of 100 l, to which a thermal sensor, a cooler and a nitrogen gas introducing device were equipped, 3.41 kg of wax emulsion, the whole amount of Anionic Surfactant Solution A and the whole amount of Nonionic Surfactant Solution B were charged and stirred, and then 44 l of ion-exchanged water was added. The wax emulsion was emulsion polypropylene having a number average molecular weight of 3,000, the number average primary particle diameter of 120 nm and a solid component concentration of 29.9%.

The mixture was heated by 75° C. and the whole amount of Initiator Solution C was dropped into the mixture. Thereafter, 12.1 kg of styrene, 2.88 kg of n-butyl acrylate, 1.04 kg of methacrylic acid and 548 g of t-dodecylmercaptane were dropped while maintaining the temperature at 75° C.±1° C. After finish of the dropping, the temperature was raised to 80° C.±1° C. and the reacting liquid was heated and stirred for 6 hours. Then the liquid temperature was lowered by 40° C. or less and stirring was stopped. The liquid was filtered by a Poul Filter to obtain latex. The latex was referred to as Latex A The resin particle of Latex A had a glass transition point of 57° C., a softening point of 121° C., a weight average molecular weight of 12,700 and a weight average particle diameter of 120 nm.

A solution composed of 0.055 kg of sodium dodecylbenzenesulfonate and 4.0 l of ion-exchanged water was prepared. The solution was referred to as Anionic Surfactant Solution D.

A solution composed of 0.014 kg of a nonylphenol adduct with 10 moles of polyethylene oxide and 4.0 l of ion-exchanged water was prepared. The solution was referred to as Nonionic Surfactant Solution E.

A solution composed of 200.7 g of potassium persulfate, produced by Kanto Kagaku Co., Ltd., and 12.0 l of ion-exchanged water was prepared. The solution was referred to as Initiator Solution F.

Into a glass lining reaction vessel with a volume of 100 l, to which a thermal sensor, a cooler, a nitrogen gas introducing device and a comb-shaped baffle are equipped, 3.41 kg of wax emulsion, the whole amount of Anionic Surfactant Solution D and the whole amount of Nonionic Surfactant Solution E were charged and stirred. The wax emulsion was emulsion polypropylene having a number average molecular weight of 3,000 and the number average primary particle diameter of 120 nm and a slid component concentration of 29.9%.

And then 44.0 l of ion-exchanged water was added. The mixture liquid was heated by 70° C. and Initiator Solution F was added. Thereafter, a previously prepared mixture of 11.0 kg of styrene, a mixture of 4.00 kg of n-butyl acrylate, 1.04 kg of methacrylic acid and 9.02 kg of t-dodecylmercaptane was dropped. After finish of the dropping, the liquid was continuously heated and stirred for 6 hours while maintaining the temperature at 72° C.±2° C. The temperature was further raised by 80° C.±2° C. and heated and stirred for 12 hours. Then liquid temperature was lowered by 40° C. and the stirring was stopped. The liquid was filtered by Pall Filter. Thus obtained filtrate was referred to as Latex B.

The resin particle of Latex B had a glass transition point of 58° C., a softening point of 132° C., a weight average molecular weight of 245,000 and a weight average particle diameter of 110 nm.

A solution composed of 5.36 kg of sodium chloride and 20.0 l of ion-exchanged water was prepared. The solution was referred to as Sodium Chloride Solution G.

A solution composed of 1.00 g of a fluorinated nonionic surfactant and 1.00 l of ion-exchanged water was prepared. The solution was referred to as Nonionic Surfactant Solution H.

Into a SUS reaction vessel with a volume of 100 l, to which a thermal sensor, a cooler, a nitrogen gas introducing device and an apparatus for monitoring the diameter and the shape of the particle were equipped, 20.0 kg of the above-prepared Latex A, 5.2 kg of Latex B, 0.4 kg of the colorant dispersion and 20.0 kg of ion-exchanged water were charged and stirred. The liquid was heated by 40° C. and Sodium Chloride Solution G, 6.00 kg of isopropanol, produced by Kanto Kagaku Co., Ltd., and Nonionic Surfactant Solution H were added in this order. After standing for 10 minutes, the liquid was heated by 85° C. spending for 60 minutes, and heated and stirring for 0.5 to 3 hours at 85° C.±2° C. for growing the particles by salting out and adhering by fusion (salting out/fusion-adhering process). Then 2.1 l of purified water was added to stop the particle growing. Thus a dispersion of fusion-adhered particle dispersion was prepared.

Into a 5 l reaction vessel to which a thermal sensor, a cooler and an apparatus for monitoring the diameter and the shape of the particle, 5.0 kg of the above-prepared fusion-adhered particle dispersion was charged and heated and stirred for 0.5 to 15 hours at 85° C.±2° C. for shape control (shape controlling process). Then the liquid was cooled by 40° C. and the stirring was stopped. Thereafter, the particles were classified by centrifugation in the liquid using a centrifuge and filtered by a sieve having an opening of 45 μm. Thus obtained filtrate is referred to as Associated Liquid. Non-spherical particles in a wet cake-like state were separated from Associated Liquid by filtration and washed by ion exchanged water. The non-spherical particles was dried at 60° C. by a flash jet drier and then further dried by a fluidized layer drying machine. To 100 parts by weight of above-prepared colored particles, 0.5 parts by weight of hydrophobic silica having a hydrophobic degree of 75 and a number average primary particle diameter of 12 nm and 0.25 parts by weight of titanium oxide having a particle size of 0.05 μm was added and mixed for 10 minutes at 52° C. by a Henschel mixer at a circumference speed of 40 m/s. Thus Toner 1Bk was prepared.

Toner 1Ya was prepared in the same manner as in Toner 1Bk except that C. I. Pigment Yellow 185 was used in place of the carbon black. Toner 1Yb was obtained by the same manner in Toner 1Ya except that the circumference speed of the Henschl mixer was lowered a little.

Toner 1M was prepared in the same manner as in Toner 1Bk except that C. I. Pigment Red 122 was used in place of the carbon black.

Toner 1C was prepared in the same manner as in Toner 1Bk except that C. I. Pigment Blue 15:3 was used in place of the carbon black. The number average diameter and $M(m_2+m_2)$ of each of Toners 1Bk, 1Ya, 1M and 1C are listed in Table 1, and the turbidity of the toners are listed in Table 2. The number average particle diameter and $M(m_2+m_2)$ of Toner 1Yb was almost the same as those of Toner Ya.

<Preparation of Toners 2Bk, 2Ya–2Yf, 2M and 2C>

Toners 2Bk, 2Ya–2Yf, 2M and 2C were each prepared in the same manner as in Toners 1Bk, 1Y, 1M and 1C, respectively, except that hydrophobic silica having a hydrophobic degree of 77, and a number average primary particle diameter of 20 nm was used in pace of the silica having a hydrophobic degree of 75 and a number average primary particle diameter of 12 nm. Results of the turbidimetry of Toners 2Bk, 2Ya–2Yf, 2M and 2C are listed in Table 2. The number average particle diameter and $M(m_2+m_2)$ of Toners 2Bk, 2Ya–2Yf, 2M and 2C are each almost the same as those of Toners 1Bk, 1Y, 1M and 1C, respectively.

<Preparation of Toners 3Bk, 3Ya–3Yd, 3M and 3C>

Toners 3Bk, 3Ya–3Yd, 3M and 3C were prepared in the same manner as in 1Bk, 1Y, 1M and 1C except that the amount of the hydrophobic silica having a hydrophobilized degree of 75 and a number average primary particle diameter of 12 nm was changed from 0.5 parts by weight to 1.8 parts by weight and the circumference speed of the Henschel mixer and the stirring time were varied. The number average particle diameter and $M(m_2+m_2)$ of Toners 3Bk, 3Ya–3Yd, 3M and 3C are each almost the same as those of Toners 1Bk, 1Y, 1M and 1C, respectively.

<Preparation of Toners 4Bk, 4Ya–4Tc, 4M and 4C>

Toners 4Bk, 4Y, 4M and 4C were prepared in the same manner as in Toners 1Bk, 1Y, 1M and 1C except that 0.5 parts by weight of the hydrophobic silica having a hydrophobilized degree of 75 and a number average primary particle diameter of 12 nm was replaced by 1.8 parts by weight of the hydrophobic silica having a hydrophobilized degree of 77 and a number average primary particle diameter of 20 nm, and the circumference speed of the Henschel mixer and the stirring time were varied. Results of turbidimetry of Toners 4Bk, 4Ya–4Yc, 4M and 4C are listed in Table 2. The number average particle diameter and $M(m_2+m_2)$ of Toners 4Bk, 4Ya–4Yc, 4M and 4C are each almost the same as those of Toners 1Bk, 1Y, 1M and 1C, respectively.

<Preparation of Toners 5Bk, 5Y, 5Ma–5Mc and 5C>

Toners 5Bk, 5Y, 5Ma–5Mc and 5C were prepared in the same manner as in Toners 1Bk, 1Y, 1M and 1C except that 0.5 parts by weight of the hydrophobic silica having a hydrophobilized degree of 75 and a number average primary particle diameter of 12 nm was replaced by 3.3 parts by weight of the hydrophobic silica having a hydrophobilized degree of 77 and a number average primary particle diameter of 20 nm, and the circumference speed of the Henschel mixer and the stirring time were varied. Results of turbidimetry of Toners 5Bk, 5Y, 5Ma–5Mc and 5C are listed in Table 2. The number average particle diameter and $M(m_2+m_2)$ of Toners 5Bk, 5Y, 5Ma–5Mc and 5C are each almost the same as those of Toners 1Bk, 1Y, 1M and 1C, respectively.

<Preparation of Toners 6Bk, 6Y, 6M and 6Ca–6Cc>

Toners 6Bk, 6Y, 6M and 6Ca–6Cc were prepared in the same manner as in Toners 1Bk, 1Y, 1M and 1C except that the circumference speed of the Henschel mixer and the stirring time were varied. Results of turbidimetry of Toners 6Bk, 6Y, 6M and 6Ca–6Cc are listed in Table 2. The number average particle diameter and $M(m_2+m_2)$ of Toners 6Bk, 6Y, 6M and 6Ca–6Cc are each almost the same as those of Toners 1Bk, 1Y, 1M and 1C, respectively.

TABLE 1

| Toner No. | Number average diameter of toner particles (μm) | $M(m_1 + m_2)$ (%) |
|---|---|---|
| 1Bk | 5.6 | 80.7 |
| 1Ya | 5.7 | 78.8 |
| 1M | 5.6 | 81.3 |
| 1C | 5.6 | 80.3 |

For evaluation, Developers 1Bk to 1C, 2Bk to 2C, 3Bk to 3C, 4Bk to 4C, 5Bk to 5C and 6Bk to 6Cc were each prepared by mixing 100 parts by weight of ferrite carrier having a size of 45 μm with Toners 1Bk to 1C, 2Bk to 2C, 3Bk to 3C, 4Bk to 4C, 5Bk to 5C and 6Bk to 6Cc, respectively.

<Preparation of Photoreceptor>

Photoreceptors to be used in examples were prepared as follows. Four kinds of photoreceptor were prepared since the photoreceptors of the same kind were installed in the image forming units used for one example.

Preparation of Photoreceptor 1

The following interlayer coating liquid was prepared and coated by an immersion coating onto a cylindrical aluminum substrate previously cleaned to form an interlayer with a dry thickness of 0.3 μm.

Interlayer (which can be Called Undercoating-Layer "UCL") Coating Liquid

| | |
|---|---|
| Polyamide resin Amilan-8000 (Toray Co., Ltd.) | 60 g |
| Methanol | 1600 ml |

The following components were mixed and dispersed by a sand mill for 10 hours to prepare a coating liquid of charge generation layer. The coating liquid was coated by an

TABLE 2

| Combination No. | Area of laser light spot ($\mu m^2$) | Pixel density (pdi) | Developer group (Toner group) No. | Developer Bk No. = Toner Bk No. | | Developer Y No. = Toner Y No. | | Developer M No. = Toner M No. | | Developer C No. = Toner C No. | | Turbidity difference (Maximum − Minimum) | Remarks |
|---|---|---|---|---|---|---|---|---|---|---|---|---|---|
| | | | | Toner No. | Turbidity | Toner No. | Turbidity | Toner No. | Turbidity | Toner No. | Turbidity | | |
| 1 | 790 | 800 | 1 | 1Bk | 6.2 | 1Ya | 10.3 | 1M | 6.6 | 1C | 6.4 | 4.1 | Comp. |
| 2 | 790 | 800 | 2 | 1Bk | 6.2 | 1Yb | 11.4 | 1M | 6.6 | 1C | 6.4 | 5.2 | Inv. |
| 3 | 790 | 800 | 3 | 2Bk | 12.5 | 2Ya | 18.3 | 2M | 12.0 | 2C | 11.3 | 7.0 | Inv. |
| 4 | 790 | 800 | 4 | 2Bk | 12.5 | 2Yb | 22.1 | 2M | 12.0 | 2C | 11.3 | 10.8 | Inv. |
| 5 | 100 | 2250 | 4 | 2Bk | 12.5 | 2Yb | 22.1 | 2M | 12.0 | 2C | 11.3 | 10.8 | Inv. |
| 6 | 400 | 1100 | 4 | 2Bk | 12.5 | 2Yb | 22.1 | 2M | 12.0 | 2C | 11.3 | 10.8 | Inv. |
| 7 | 1200 | 650 | 4 | 2Bk | 12.5 | 2Yb | 22.1 | 2M | 12.0 | 2C | 11.3 | 10.8 | Inv. |
| 8 | 1900 | 516 | 4 | 2Bk | 12.5 | 2Yb | 22.1 | 2M | 12.0 | 2C | 11.3 | 10.8 | Inv. |
| 9 | 2100 | 490 | 4 | 2Bk | 12.5 | 2Yb | 22.1 | 2M | 12.0 | 2C | 11.3 | 10.8 | Inv. |
| 10 | 790 | 800 | 5 | 2Bk | 12.5 | 2Yc | 35.3 | 2M | 12.0 | 2C | 11.3 | 24.0 | Inv. |
| 11 | 790 | 800 | 6 | 2Bk | 12.5 | 2Yd | 46.0 | 2M | 12.0 | 2C | 11.3 | 34.7 | Inv. |
| 12 | 790 | 800 | 7 | 2Bk | 12.5 | 2Ye | 55.1 | 2M | 12.0 | 2C | 11.3 | 43.8 | Inv. |
| 13 | 790 | 800 | 8 | 2Bk | 12.5 | 2Yf | 58.3 | 2M | 12.0 | 2C | 11.3 | 47.0 | Comp. |
| 14 | 790 | 800 | 9 | 3Bk | 18.5 | 3Ya | 33.4 | 3M | 19.3 | 3C | 23.8 | 14.9 | Inv. |
| 15 | 790 | 800 | 10 | 3Bk | 18.5 | 3Yb | 46.0 | 3M | 19.3 | 3C | 23.8 | 27.5 | Inv. |
| 16 | 100 | 2250 | 10 | 3Bk | 18.5 | 3Yb | 46.0 | 3M | 19.3 | 3C | 23.8 | 27.5 | Inv. |
| 17 | 400 | 1100 | 10 | 3Bk | 18.5 | 3Yb | 46.0 | 3M | 19.3 | 3C | 23.8 | 27.5 | Inv. |
| 18 | 1200 | 650 | 10 | 3Bk | 18.5 | 3Yb | 46.0 | 3M | 19.3 | 3C | 23.8 | 27.5 | Inv. |
| 19 | 1900 | 516 | 10 | 3Bk | 18.5 | 3Yb | 46.0 | 3M | 19.3 | 3C | 23.8 | 27.5 | Inv. |
| 20 | 790 | 800 | 11 | 3Bk | 18.5 | 3Yc | 56.8 | 3M | 19.3 | 3C | 23.8 | 38.3 | Inv. |
| 21 | 790 | 800 | 12 | 3Bk | 18.5 | 3Yd | 63.3 | 3M | 19.3 | 3C | 23.8 | 44.8 | Comp. |
| 22 | 790 | 800 | 13 | 4Bk | 22.3 | 4Ya | 33.8 | 4M | 29.3 | 4C | 30.5 | 11.5 | Inv. |
| 23 | 790 | 800 | 14 | 4Bk | 22.3 | 4Yb | 55.6 | 4M | 29.3 | 4C | 30.5 | 33.3 | Inv. |
| 24 | 790 | 800 | 15 | 4Bk | 22.3 | 4Yc | 62.2 | 4M | 29.3 | 4C | 30.5 | 39.9 | Comp. |
| 25 | 790 | 800 | 16 | 5Bk | 31.5 | 5Y | 35.6 | 5Ma | 33.2 | 5C | 44.7 | 13.2 | Inv. |
| 26 | 790 | 800 | 17 | 5Bk | 31.5 | 5Y | 35.6 | 5Mb | 55.1 | 5C | 44.7 | 23.6 | Inv. |
| 27 | 790 | 800 | 18 | 5Bk | 31.5 | 5Y | 35.6 | 5Mc | 63.3 | 5C | 44.7 | 31.8 | Comp. |
| 28 | 790 | 800 | 19 | 6Bk | 6.4 | 6Y | 7.3 | 6M | 5.3 | 6Ca | 12.1 | 6.8 | Inv. |
| 29 | 790 | 800 | 20 | 6Bk | 6.4 | 6Y | 7.3 | 6M | 5.3 | 6Cb | 23.4 | 18.1 | Inv. |
| 30 | 790 | 800 | 21 | 6Bk | 6.4 | 6Y | 7.3 | 6M | 5.3 | 6Cc | 52.4 | 47.1 | Comp. |

Inv.; Inventive
Comp.; Comparative immersion method onto the interlayer to form a charge generation layer with a dry thickness of 0.2 μm.

| Charge generation layer (CGL) coating liquid | |
|---|---|
| Y-type titanylphthalocyanine having the maximum peak of diffraction of Cu-Kα characteristic X-ray at an angle 2θ of 27.3° | 60 g |
| Silicone resin solution KR5240 15%-xyrene/butanol solution (Shin'etsu Kagaku Co., Ltd.) | 700 g |
| 2-butanone | 2000 ml |

The following components were mixed and dissolved to prepare a charge transfer layer coating liquid. The coating liquid was coated on the charge generation layer by an immersion method to form a charge transfer layer having a dry thickness of 20 μm.

| Charge transfer layer (CTL) coating liquid | |
|---|---|
| Charge transfer substance; 4-methoxy-4'-(4-methyl-α-phenylstyryl)-triphenylamine | 200 g |
| Bis-phenol Z type polycarbonate; Eupiron Z300 (Mitsubishi Gas Kagaku Co., Ltd.) | 300 g |
| Hindered amine; Sanol LS2626 (Sankyo Co., Ltd.) | 3 g |
| 1,2-dichloroethane | 2000 ml |

Preparation of Photoreceptor 2

| Surface protective layer | |
|---|---|
| Charge transfer substance; 4-methoxy-4'-(4-methyl-α-phenylstyryl)-triphenylamine | 200 g |
| Bis-phenol Z type polycarbonate; Eupilon Z300 (Mitsubishi Gas Kagaku Co., Ltd.) | 300 g |
| Hindered amine; Sanol LS2626 (Sankyo Co., Ltd.) | 3 g |
| Colloidal silica, 30% methanol solution | 8 g |
| Polytetrafluoroethylene resin particle, average particle diameter of 0.5 μm | 100 g |
| 1-butanol | 50 g |

The above components were dissolved to prepare a surface protective layer coating liquid. The coating liquid was coated on the charge transfer layer by an immersion coating method and thermally hardened for 40 minutes at 100° C. to form a surface protective layer having a dry thickness of 4 μm. Thus Photoreceptor 2 was prepared.

Example 1

Example Using Photoreceptor Containing Fluororesin Particles in the Surface Layer <Evaluation>

The spot area of the laser light as the exposing means of each image forming unit and the group of developers were combined as Combination Nos. 1 through 30 listed in Table 2, and the combinations are each installed in the digital copying machine having the developing means of Yellow Y, Magenta M, cyan C and Black Bk and the intermediate transferring member. An A4 size original image including a white background, solid images of Bk, Y, M and C, character images and a halftone image was copied 10,000 times under a ordinary temperature and humidity condition at a temperature of 20° C. and a relative humidity of 50%, and the copies were evaluated according to the following evaluation items, evaluation methods and evaluation norms. The spot areas of the laser light beams were unified in every combination numbers. The pixel density pdi was changed according to the spot area.

Scattering of Character Image

A character image was prepared and the scattering of the toner around the image of the characters was observed by human eyes and through a loupe with a magnitude of 20 times and evaluated according to the following norms.

A: No scattered toner around the character was observed by the loupe observation; good.

B: Scattered toner around the character cannot be seen by the human eyes but can be observed through the loupe; no problem was raised in the practical use.

C: Scattered toner around the character was observed by the human eyes and the sharpness of the character was inferior; a problem rose in the practical use.

Lacking of Toner Transfer

Halftone images each having a density of 0.4 was formed on both sides of the recording paper with a weight of 200 g/m$^2$, and the occurrence of a white spot caused by the lacking of toner transfer was visibly observed and evaluated according to the following norms.

A: Any lacking of toner transfer was not observed; excellent.

B: There were one or two white spots only on backside per 100 copies but the white spot can be distinguished only by gazing; good.

C: There were one through 4 white spots per 50 copies but the white spot can be distinguished only by gazing; no problem for practical use.

D: There were 5 or more spots without relation of the side per 50 copies; a problem rose in the practical use.

Black Spot

The black spot occurrence was evaluated by the number of black spot or the strawberry like shaped spot periodically formed corresponding to the cycle of the photoreceptor in an A4 size copy.

A: The occurrence frequency of the black spot of not less than 0.4 mm: three or less spots per A4 size copy in whole copies; good.

B: The occurrence frequency of the black spot of not less than 0.4 mm: one or more copies were found on which from 4 to 15 black spots per A4 size copy, no problem for practical use.

C: The occurrence frequency of the black spot of not less than 0.4 mm: one or more copies were found on which from 16 or more black spots per A4 size copy; a problem rose in the practical use.

Image Density

The relative image density based on the density of recording paper set at 0 was measured at the solid image of each color by a densitometer RD-918, manufactured by Macbeth Co., Ltd.

A: The density of each of the solid images of Bk, Y, M and C was not less than 1.2; good.

B: The density of each of the solid images of Bk, Y, M and C was not less than 0.8; no problem for practical use.

C: The density of each of the solid images of Bk, Y, M and C was less than 0.8; a problem rose in the practical use.

Sharpness

The sharpness of the image was evaluated according to the spreading of the character image formed by copying under a high temperature and high humidity condition at a temperature of 30° C. and a relative humidity of 80%. The character image was that of 3 point and 5 point characters. The evaluation was performed according to the following norms.

A: Both of the images of 3 point and 5 point characters were clear and easily readable.

B: The images of the 3 point characters were partially unreadable, and the images of the 5 point were easily readable.

C: Almost all of the images of the 3 point characters were unreadable and a part or all of the images of the 5 point characters were unreadable.

Processing Condition of the Digital Copying Machine Having the Intermediate Transferring Member Line speed L/S of image formation: 180 mm/s Charging condition of the photoreceptor having a diameter of 40 mm: The potential at the non-image area can be controlled by feedbacking the potential measured by a potential sensor and the controllable range was from −500 V to −900 V. The surface potential of the photoreceptor fully exposed was controlled within the range of from −50 V to 0 V.

Light for post exposure: A semiconductor laser with a wavelength of 780 nm

Intermediate transferring member: A seamless endless belt intermediate transferring member 70 was used which was a belt made from a semi-electroconductive resin having a volume resistivity of $1\times10^8$ Ω·cm and a ten point surface roughness Rz of 0.9 μm.

Primary Transferring Condition

Primary transferring roller, 5Y, 5M, 5C and 5Bk shown in FIG. 1 each having a diameter of 6.05 mm. The roller constituted by a metal core and covered with elastic rubber which had a surface resistivity of $1\times10^6$ Ω·cm, and transferring potential was applied to the roller.

Secondary Transferring Condition

The backup roller 74 and the secondary transferring roller 5A were arranged at the both sides of the endless belt-shaped intermediate transferring member 70. In such the system, the resistivity of the backup roller 74 was $1\times10^6$ Ω·cm and that of the secondary transferring roller as the secondary transferring means was $1\times10^6$ Ω·cm and the electric current through the roller was constantly controlled at about 80 μA.

The fixing was performed by a thermal fixing system using the fixing roller, interior of which a heater was equipped. The distance Y from the initial contact point of the intermediate transferring member with the photoreceptor to the initial contact point of the intermediate transferring member with the next photoreceptor was 95 mm.

The circumference length of the driving roller 71, the guide rollers 72 and 73, and the backup roller for the secondary transferring were each 31.67 mm (=95 mm/3) and that of the tension roller 76 was 23.75 mm (=95 mm/4).

The circumference length of the primary transferring roller was 19 mm (=95 mm/5).

Cleaning Condition of the Photoreceptor

Cleaning blade: A urethane rubber blade was touched to the photoreceptor in the counter direction to the rotating direction of the photoreceptor.

Cleaning Condition of the Intermediate Transferring Member

Cleaning blade: A urethane rubber blade was touched to the intermediate transferring member in the counter direction to the running direction of the intermediate transferring member.

Results of the evaluation are listed in Table 3.

TABLE 3

| Combination No. | Spot area of the laser light beam ($\mu m^2$) | Pixel density (dpi) | Developer group (Toner group) No. | Scattering of character image | Lacking of toner transfer | Black spot | Image density | Sharpness | Remarks |
|---|---|---|---|---|---|---|---|---|---|
| 1 | 790 | 800 | 1 | B | D | B | C | C | Comp. |
| 2 | 790 | 800 | 2 | A | C | B | B | B | Inv. |
| 3 | 790 | 800 | 3 | A | C | A | B | A | Inv. |
| 4 | 790 | 800 | 4 | A | A | A | A | A | Inv. |
| 5 | 100 | 2250 | 4 | A | A | A | A | A | Inv. |
| 6 | 400 | 1100 | 4 | A | A | A | A | A | Inv. |
| 7 | 1200 | 650 | 4 | B | B | A | A | B | Inv. |
| 8 | 1900 | 516 | 4 | B | B | A | A | B | Inv. |
| 9 | 2100 | 490 | 4 | B | C | A | B | C | Inv. |
| 10 | 790 | 800 | 5 | A | A | A | A | A | Inv. |
| 11 | 790 | 800 | 6 | A | A | B | A | A | Inv. |
| 12 | 790 | 800 | 7 | A | B | B | A | B | Inv. |
| 13 | 790 | 800 | 8 | C | C | B | B | C | Comp. |
| 14 | 790 | 800 | 9 | A | A | A | A | A | Inv. |
| 15 | 790 | 800 | 10 | A | A | B | A | A | Inv. |
| 16 | 100 | 2250 | 10 | A | A | B | A | A | Inv. |
| 17 | 400 | 1100 | 10 | A | A | B | A | A | Inv. |
| 18 | 1200 | 650 | 10 | B | B | A | A | B | Inv. |
| 19 | 1900 | 516 | 10 | B | B | A | A | B | Inv. |
| 20 | 790 | 800 | 11 | A | B | B | A | B | Inv. |
| 21 | 790 | 800 | 12 | B | C | C | B | C | Comp. |
| 22 | 790 | 800 | 13 | B | B | A | A | A | Inv. |
| 23 | 790 | 800 | 14 | B | B | B | A | A | Inv. |
| 24 | 790 | 800 | 15 | C | C | C | B | C | Comp. |
| 25 | 790 | 800 | 16 | B | B | B | A | A | Inv. |
| 26 | 790 | 800 | 17 | B | B | B | A | A | Inv. |
| 27 | 790 | 800 | 18 | C | C | C | C | C | Comp. |
| 28 | 790 | 800 | 19 | A | C | B | B | B | Inv. |

TABLE 3-continued

| Combination No. | Spot area of the laser light beam ($\mu m^2$) | Pixel density (dpi) | Developer group (Toner group) No. | Scattering of character image | Lacking of toner transfer | Black spot | Image density | Sharpness | Remarks |
|---|---|---|---|---|---|---|---|---|---|
| 29 | 790 | 800 | 20 | A | A | A | A | A | Inv. |
| 30 | 790 | 800 | 21 | C | D | B | B | C | Comp. |

Inv.; Inventive
Comp.; Comparative

It is understood from the results listed in Table 3 that the combination satisfying the requirements of the invention, namely the combination of the laser beam spot area of not more than 2,000 $\mu m^2$ and the developer group in which the largest difference among the color toners was within the range of from 5 to 45, Combination Nos. 2 to 8, 10 to 12, 14 to 20, 22, 23, 25, 26, 28 and 29, attain good evaluation results higher than the level of practical use in the character scattering, toner transfer lacking, black spot, image density and sharpness. Contrary, satisfactory results cannot be obtained by the combination using the developer group not satisfying the requirements of the invention, Combinations Nos. 1, 13, 21, 24, 27 and 30. By Combination No. 1 in which the difference among the turbidity of the color toners was 4.1, the fluidity of the toner is insufficient and the transferring ability, image density and sharpness are degraded. By Combination Nos. 13, and 30 in which the difference of the turbidity was 47, the scattering of character image (scattering of color character image) was large and the sharpness was degraded since the balance of the charging amounts was made instable. By No. 30, the lacking of toner transfer occurred also. By the developer group, Nos. 21, 24 and 27, in which at least one of the toners of the turbidity of the developer group is 60 or more, much black spots were formed and the sharpness was degraded since the amount of the free external additive was excessive. Among the combination each satisfying the requirements of the invention, the improvement effects of Combinations, Nos. 4, 5, 6, 10, 11, 14, 15, 16, 17 and 29, in each of which the area of the light spot was within the range of from 100 to 800 $\mu m^2$ and the largest difference of the turbidity among the colored toner was from 10 to 35 and the turbidity of the black toner was less than 20, the improvement effects were considerably larger compared with Combination No. 9 in which the spot area of the laser light beam of the exposure means was larger than 2.000 $\mu m^2$.

Example 2

Example of the Use of Photoreceptor and the Surface Energy Reducing Agent is Supplied Photoreceptors 2 in the digital copying machine having the intermediate transferring member in Example 1 were each replaced by Photoreceptors 1 and the cleaning means was replaced by the cleaning means shown in FIG. 5 having the brush roller serving both as cleaning means and the agent supplying means, and zinc stearate was attached at 66K in FIG. 5. The evaluation was performed while supplying the zinc stearate to the photoreceptor surface through the brush roller in the same manner as in Example 1 using the developer groups (toner groups) illustrated in Table 2. The items, methods and norms of the evaluation were the same as those in Example 1.

Cleaning Condition by the Cleaning Means Having the Agent Supplying Means Shown in FIG. 5.

Cleaning blade: A urethane rubber blade touched to the photoreceptor in the counter direction to the rotation direction of the photoreceptor.

Cleaning brush: Electroconductive acryl resin having a brush fiber density of $3\times10^3/cm^2$; the sinking depth of the brush fiber was set at 1.0 mm.

The evaluation was carried out under the foregoing conditions. The evaluation results almost the same as those in Example 1 were obtained by the evaluation. Namely, it was found that the same effects in Example 1 can be obtained by supplying the surface energy reducing agent to the photoreceptor surface even when the surface layer of the photoreceptor contains no fluororesin particles.

Example 3

Example of Varying the Particle Size Distribution of the Toner

Preparation of Toners 7Bk, 7Y, 7M and 7C

Toners 7Bk, 7Y, 7M and 7C were each prepared in the same manner as in Toners 2Bk, 2Yb, 2M and 2C, respectively, except that the $M(m_1+m_2)$ was varied by varying the classifying level by the centrifuge in the liquid. The number average particle diameter, the $M(m_1+m_2)$ and the turbidity of the toners are shown in Table 4.

Developer Group No. 22 composed of Toners 7Bk, 7Y, 7M and 7C was prepared by mixing 10 parts by weight of each of the above toners was mixed with 100 parts by weight of the ferrite carrier of 45 μm coated with styrene/methacrylate copolymer.

Preparation of Toners 8Bk, 8Y, 8M and 8C

Toners 8Bk, 8Y, 8M and 8C were each prepared in the same manner as in Toners 2Bk, 2Yb, 2M and 2C, respectively, except that the $M(m_1+m_2)$ was varied by varying the classifying level by the centrifuge in the liquid. The number average particle diameter, the $M(m_1+m_2)$ and the turbidity of the toners are shown in Table 4.

Developer Group No. 23 composed of Toners 8Bk, 8Y, 8M and 8C was prepared by mixing 10 parts by weight of each of the above toners was mixed with 100 parts by weight of the ferrite carrier of 45 μm coated with styrene/methacrylate copolymer.

TABLE 4

| Developer Group No. | Toner No. | Number average diameter of toner particles (μm) | $M(m_1 + m_2)$ (%) | Turbidity of toner | Turbidity difference (Largest − Smallest) |
|---|---|---|---|---|---|
| 22 | 7Bk | 4.4 | 71.4 | 13.5 | 12.1 |
| | 7Y | 4.5 | 72.6 | 25.6 | |
| | 7M | 4.4 | 71.2 | 14.7 | |
| | 7C | 4.4 | 72.1 | 15.7 | |
| 23 | 8Bk | 4.6 | 68.1 | 22.3 | 14.9 |
| | 8Y | 4.7 | 68.3 | 37.2 | |
| | 8M | 4.6 | 67.6 | 23.3 | |
| | 8C | 4.6 | 68.2 | 23.6 | |

Combination Nos. 31 and 32 were prepared in the same manner as in Combination No. 4 in Example 1 except that Developer Group No. 4 of Toners 2Bk, 2Yb, 2M and 2C was each replaced by Developer Group Nos. 22 and 23, respectively, and the evaluation was performed in the same manner as in Example 1. Results of the evaluation are listed in Table 5.

TABLE 5

| Combination No. | Spot area of laser light beam ($\mu m^2$) | Pixel density (dpi) | Developer Group (Toner Group) No. | Scattering of character image | Lacking of toner transfer | Black spot | Image density | Sharpness |
|---|---|---|---|---|---|---|---|---|
| 31 | 790 | 800 | 22 | A | B | A | A | A |
| 32 | 790 | 800 | 23 | B | C | B | A | B |

It is found in Table 5, Developer Group No. 22 in which the sum M of the relative frequency of the toner particles is not less than 70% is superior to the developer group in which M is less than 70% in the improving degree of each of the evaluated items.

Example 4

Example Using Photoreceptor Containing Fluororesin Particles in the Surface Layer Thereof Evaluation The foregoing Photoreceptor 2 was installed in each of the image forming unit of the tandem type digital copying machine shown in FIG. 6, and the developer groups listed in Table 2, Developer Group Nos. 1 through 21, were successively charged in the developing means. The evaluation similar to that in Example 1 was carried out under the following conditions. As the result of that, the evaluation results almost the same as those in Example 1 were obtained.

Condition of the Evaluation

Line speed of image formation L/S: 180 mm/sec.

Charging condition of the photoreceptor having a diameter of 40 mm: The potential at the non-image area can be controlled by feedbacking the potential measured by a potential sensor and the controllable range was from −500 V to −900 V. The surface potential of the photoreceptor fully exposed was controlled within the range of from −50 V to 0 V.

Light for imagewise exposure: Semiconductor laser, wavelength of 780 nm

Transferring Condition

Transferring belt: A belt made from urethane rubbed in which carbon was dispersed was used. The stretching ratio under the using condition was 3%.

Transferring electrode: Corona discharger, the distance between the discharging wire and each of the photoreceptors 21Y, 21M, 21C and 21Bk was 7.0 mm; the diameter of the discharging wire was 0.08 mm; the material of the discharging wire was $WO_3$; and the material of the electrode plate was SUS 304.

Voltage of the power source of the transferring current: +3 kV to +7.5 kV.

Cleaning Condition of the Photoreceptor

Cleaning blade: The urethane rubber blade was touched to the photoreceptor in the counter direction to the rotating direction of the photoreceptor.

Example 5

Example Using Photoreceptor to which the Surface Energy Reducing Agent was Supplied In the tandem type digital copying machine used in Example 4, Photoreceptors 2 in each of the image forming units were replaced by Photoreceptors 1 and the cleaning means was replaced by the cleaning means shown in FIG. 2 having the brush roller serving as both of the cleaning means and the agent supplying means, and zinc stearate was attached at 25K in FIG. 2. The evaluation was performed using the developer groups (toner groups) the same as in Example 4 while supplying the zinc stearate through the brush roller. The items, methods and norms of the evaluation were the same as those in Example 4.

Cleaning Condition by the Cleaning Means Having the Agent Supplying Means of FIG. 2

Cleaning blade: The urethane rubber blade was touched to the photoreceptor in the counter direction to the rotating direction of the photoreceptor.

Cleaning Brush:

Cleaning brush: Electroconductive acryl resin having a brush fiber density of $3\times10^3/cm^2$; the sinking depth of the brush fiber was set at 1.0 mm.

The evaluation was carried out under the foregoing conditions. The evaluation results almost the same as those in Example 4 were obtained by the evaluation. Namely, it was found that the same effects in Example 4 can be obtained by supplying the surface energy reducing agent to the photoreceptor surface even when the surface layer of the photoreceptor contains no fluororesin particles.

Example 6

Example of Changing the Particle Size Distribution of the Toner

The Evaluation was carried out in the same manner as in Example 4 except that Developer Group 4 including Toner 2Bk, 2Y, 2M and 2C was replace by Developer Group 22 or 23 of Example 3. Evaluation results almost the same as those in Example 3 were obtained.

According to the invention, the toner transfer ability in the electrophotography using the intermediate transferring member can be improved and the image defects such as the lacking of toner transfer and the scattering of the character image caused by lowering the toner transfer can be prevented, and the electrophotographic image forming apparatus and the image forming method forming a color image having good image density and sharpness can be provided.

What is claimed is:

1. An image forming apparatus comprising:

a plurality of image forming units each having at least an electrophotographic photoreceptor, a latent image forming device to form an electrostatic latent image on the electrophotographic photoreceptor, a developing device to develop the electrostatic latent image with toner to form visible toner image on the electrophotographic photoreceptor, a transferring device to transfer the visible toner image onto a toner image receiving member and a cleaning device to remove the toner remaining on the electrophotographic photoreceptor after transferring the visible toner image by the transferring device, wherein the plurality of image forming units are arranged so as to transfer and pile up the visible toner images successively onto the toner image receiving member to form a toner image, and wherein the toners used in each of the image forming units have different colors and the turbidity of less than 60, and the difference of the turbidity of the toner having the highest turbidity and that of the toner having the lowest turbidity among the toners is 5 to 45.

2. The image forming apparatus of claim 1, wherein said toner image receiving member is an intermediate transferring device which retransfers said toner image transferred and piled up by the image forming units onto a recording material.

3. The image forming apparatus of claim 2, wherein a surface layer of the electrophotographic photoreceptor of at least one of the plural image forming units contains a fluororesin particle, and wherein the turbidity of the each color toner is less than 50 and exceeds 5.

4. The image forming apparatus of claim 3, wherein the each color toners comprises an external additive with a number average particle diameter of 0.05 to 0.5 μm.

5. The image forming apparatus of claim 1, wherein a surface layer of the electrophotographic photoreceptor of at least one of the plural image forming units contains a fluororesin particle.

6. The image forming apparatus of claim 1, wherein at least one of the plural image forming units has an agent supplying device for supplying a surface energy reducing agent to the electrophotographic photoreceptor.

7. The image forming apparatus of claim 1, wherein the sum M of the relative frequency $m_1$ of toner particles included in the highest frequent class and the relative frequency of the toner particles $m_2$ included in the next frequent class is not less than 70% in a histogram showing the distribution of number based particle diameter classified in to plural classes at intervals of 0.23 on the horizontal axis of natural logarithm ln D, D is the diameter of the toner particle in μm.

8. The image forming apparatus of claim 1, wherein the difference of the turbidity of the toner having the highest turbidity and that of the toner having the lowest turbidity among the toners is 10 to 35.

9. The image forming apparatus of claim 1, wherein the image forming units are four image forming units composed of an image forming unit having a black toner, an image forming unit having a yellow toner, an image forming unit having a magenta toner and an image forming unit having a cyan toner.

10. The image forming apparatus of claim 9, wherein the turbidity of the black toner is less than 20.

11. The image forming apparatus of claim 1, wherein the spot area of a exposure light beam to be used as the latent image forming device of each of the plural image forming units is not more than 2,000 $\mu m^2$.

12. An image forming method, comprising the steps of:

forming respective color latent images of yellow, magenta, cyan and black, on a plurality of electrophotographic photoreceptor;

developing the respective color latent images with corresponding color toners to form respective color visible toner images; and transferring the respective color toner images successively to be piled up on a toner image receiving member, wherein each of the color toners has the turbidity of less than 60, and the difference of the turbidity of toner having the highest turbidity and that of toner having the lowest turbidity among the toners is 5 to 45.

13. The method of claim 12, wherein the turbidity of the each color toner is less than 50.

14. The method of claim 13, wherein the turbidity of the each color toner exceeds 5.

15. The method of claim 13, wherein the difference of the turbidity of the toner having the highest turbidity and that of the toner having the lowest turbidity among the toners is form 10 to 35.

16. The method of claim 15, wherein the color toners comprise an external additive with a number average particle diameter of 0.05 to 0.5 μm.

17. The method of claim 12, wherein the corresponding color toners include a black toner, a yellow toner, a magenta toner or a Cyan toner, and the toner having the largest turbidity is the yellow toner.

18. The method of claim 12, wherein said toner image receiving member is an claim Amendment intermediate transferred and piled up by the image forming units onto a recording material.

19. The method of claim 12, wherein surface layers of the electrophotographic photoreceptors contain fluororesin particles.

20. The method of claim 12, further comprising supplying a surface energy reducing agent to at least one of the electrophotographic photoreceptors.

* * * * *